US011718113B2

(12) United States Patent
Murata et al.

(10) Patent No.: US 11,718,113 B2
(45) Date of Patent: Aug. 8, 2023

(54) RECORDING APPARATUS

(71) Applicant: CANON KABUSHIKI KAISHA, Tokyo (JP)

(72) Inventors: Ryosuke Murata, Tokyo (JP); Ryo Harigae, Tokyo (JP); Itaru Wada, Kanagawa (JP); Masato Izumi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/493,382

(22) Filed: Oct. 4, 2021

(65) Prior Publication Data

US 2022/0105738 A1 Apr. 7, 2022

(30) Foreign Application Priority Data

Oct. 5, 2020 (JP) ..... 2020-168383

(51) Int. Cl.

*B41J 15/04* (2006.01)
*B41J 15/02* (2006.01)
*B65H 19/12* (2006.01)

(52) U.S. Cl.

CPC ..... *B41J 15/046* (2013.01); *B41J 15/02* (2013.01); *B41J 15/042* (2013.01); *B65H 19/126* (2013.01); *B65H 2301/41346* (2013.01); *B65H 2301/41358* (2013.01); *B65H 2511/12* (2013.01); *B65H 2511/51* (2013.01)

(58) Field of Classification Search

CPC ..... B41J 15/046; B41J 15/02; B41J 15/042; B65H 19/126; B65H 2301/41346; B65H 2301/41358; B65H 2511/12; B65H 2511/51

See application file for complete search history.

(56) References Cited

U.S. PATENT DOCUMENTS 5,637,070 A * 6/1997 Sasai ..... B41J 11/0005 493/321
8,956,062 B2 * 2/2015 Nakayama ..... B41J 15/042 400/613
11,122,175 B2 9/2021 Ohashi et al.
2002/0126191 A1 * 9/2002 Fujioka ..... B41J 11/06 347/104
2021/0276348 A1 9/2021 Suto et al.
2021/0284475 A1 9/2021 Shimamura et al.

FOREIGN PATENT DOCUMENTS

JP 2011-131434 A 7/2011

* cited by examiner

*Primary Examiner* — Henok D Legesse
(74) *Attorney, Agent, or Firm* — Venable LLP

(57) ABSTRACT

A recording apparatus includes a containing portion that contains a rolled sheet obtained by winding a sheet and a recording portion that records an image on the sheet fed from the rolled sheet contained in the containing portion and further includes an opening/closing member that can be movable between an open position at which the containing portion is opened and a closed position at which the containing portion is closed and a first guiding portion provided in the opening/closing member to guide the rolled sheet to the containing portion in a case where the opening/closing member is at the open position.

21 Claims, 17 Drawing Sheets

RECORDING APPARATUS

BACKGROUND OF THE INVENTION

Field of the Invention

The present invention relates to a recording apparatus that pulls a sheet out of a rolled sheet in a form, in which a sheet serving as a recording sheet is wound in the form of a roll, and feeds the pulled-out sheet in order to record an image on the fed sheet.

Description of the Related Art

In a recording apparatus that feeds a sheet as a recording material and records an image on the fed sheet, prior to the sheet feeding, a rolled sheet is set as the recording material in a contained form in the apparatus. As a method of setting the rolled sheet in the apparatus, a method is known which attaches a support member to both end portions of the rolled sheet and sets the rolled sheet in a sheet feed-out supporting portion of the apparatus via the support member. A recording apparatus described in Japanese Patent Application Laid-Open No. 2011-131434 temporarily places a rolled sheet, having a support member attached thereto, on a guiding portion protruding from a front side of the apparatus and slides the rolled sheet to a sheet feed-out supporting portion to set the rolled sheet.

SUMMARY OF THE INVENTION

In the recording apparatus described in Japanese Patent Application Laid-Open No. 2011-131434, an entire rolled sheet feeding portion is opened to the front side of the apparatus, and the guiding portion, on which the rolled sheet having the support member attached thereto is to be temporarily placed, is configured to protrude from the front side of the apparatus. This allows easy attachment of the rolled sheet, while the discharged sheet may easily enter the rolled sheet feeding portion and possibly cause a discharged sheet jam.

It is therefore an object of the present invention to provide a recording apparatus in which attachability of a rolled sheet is ensured and a rolled sheet feeding portion is covered.

A recording apparatus of the present invention includes:

a containing portion that contains a rolled sheet obtained by winding a sheet;

a recording portion that records an image on the sheet fed from the rolled sheet contained in the containing portion;

an opening/closing member that can be movable between an open position at which the containing portion is opened and a closed position at which the containing portion is closed; and a first guiding portion provided in the opening/closing member to guide the rolled sheet to the containing portion in a case where the opening/closing member is at the open position.

According to the present invention, it is possible to ensure the attachability of the rolled sheet and cover the rolled sheet feeding portion.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments are not intended to limit the scope of the invention to the following embodiments.

Basic Configuration of Apparatus

FIGS. 1 to 4 are illustrative views of a basic configuration of a recording apparatus of the present invention. The recording apparatus in the present embodiment is an example obtained by applying the present invention to an inkjet printing apparatus including a sheet feeding device for feeding a sheet as a recording material and a printing portion (recording portion) that prints (records) an image on the sheet.

Figure 1:
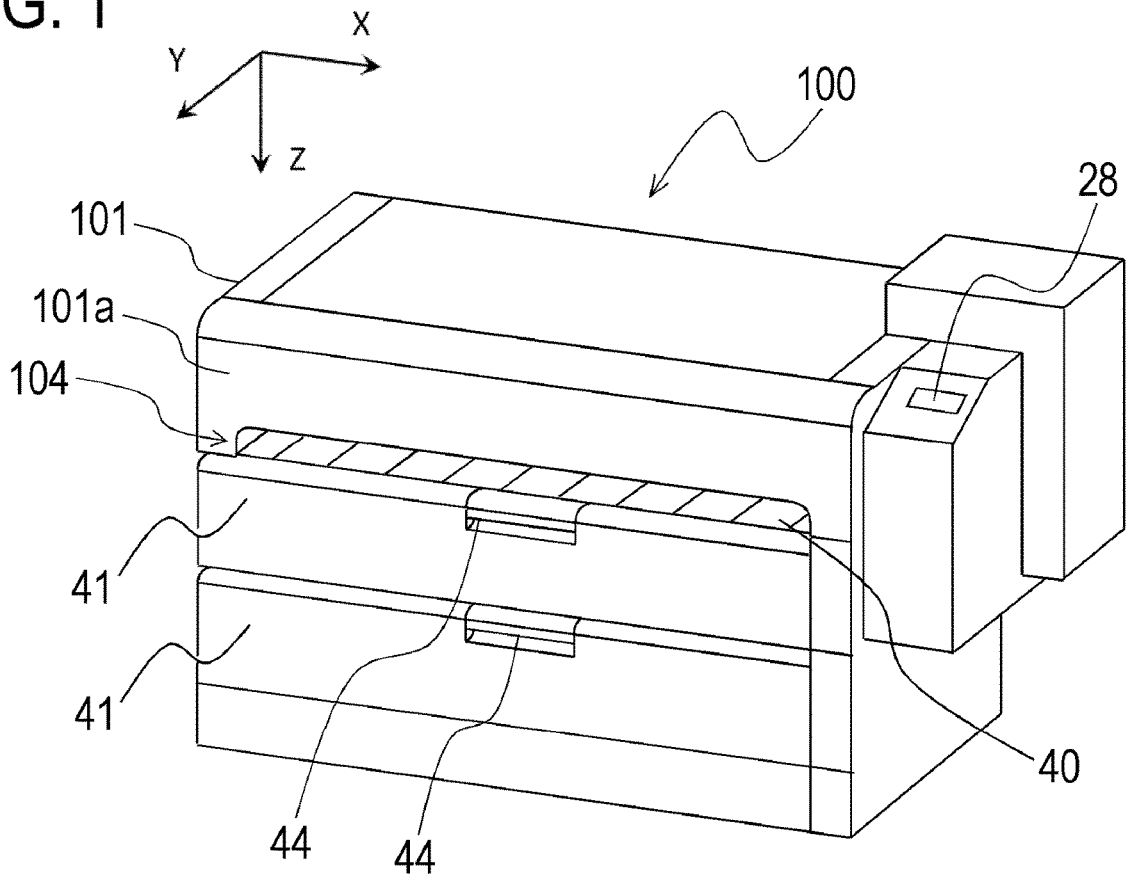
FIG. 1 is a perspective view of a printing apparatus in a first embodiment of the present invention.

FIG. 1 illustrates a printing apparatus 100 in which two rolled sheets (rolled paper) each obtained by winding a sheet 1 into the form of a roll as a contained form of the recording material can be set. On the sheet 1 selectively pulled out of either of the two rolled sheets, an image is printed. A user can input, using various switches included in an operation panel 28 or the like, various commands and the like to the printing apparatus 100, such as a size specification for the sheet 1 or online/offline switching.

Figure 2:
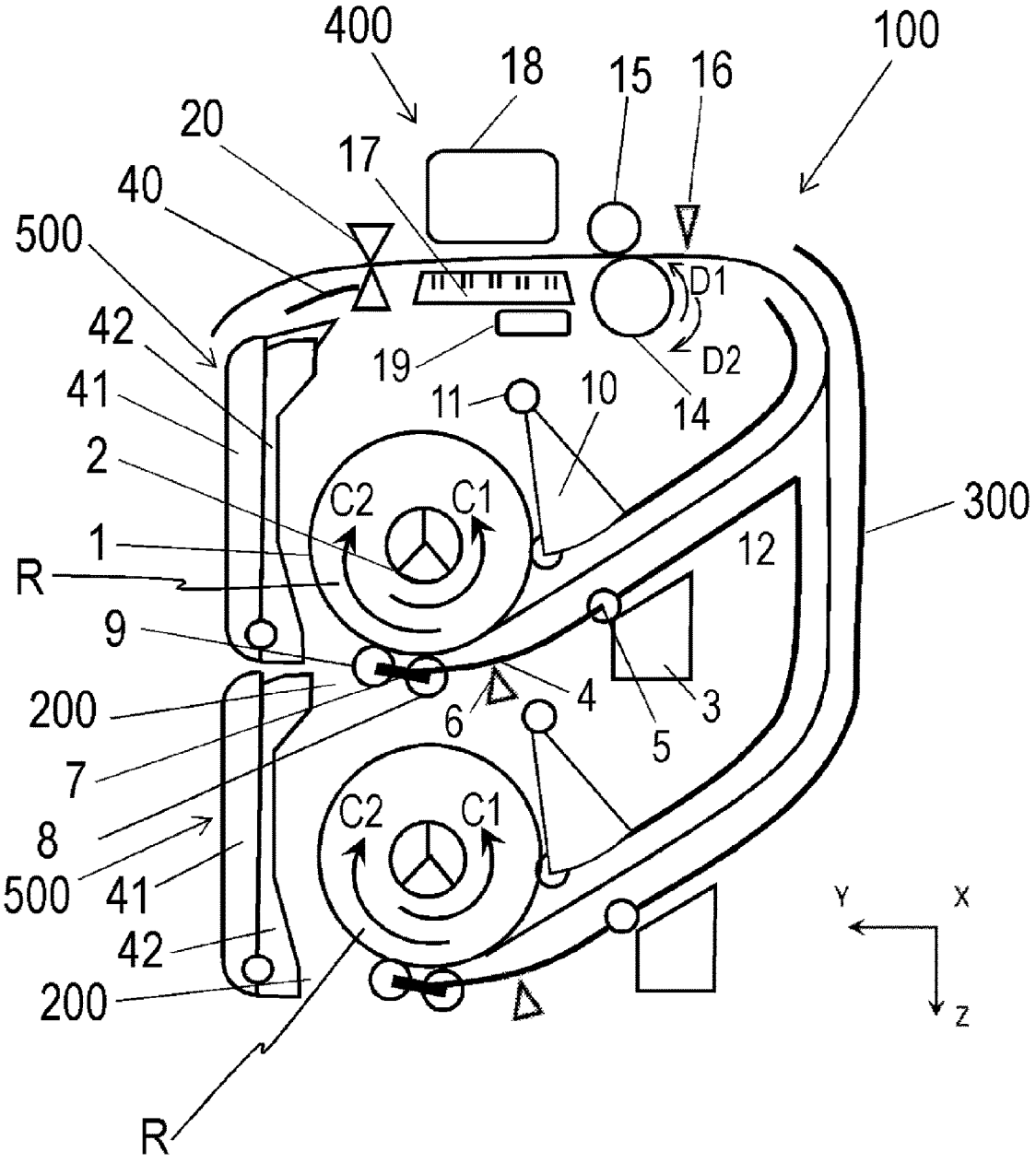
FIG. 2 is an illustrative view of a sheet conveyance path in the printing apparatus.

FIG. 2 is a schematic cross-sectional view of a main portion of the printing apparatus 100. Two sheet feeding devices 200 corresponding to two rolled sheets R are vertically disposed. The sheet 1 pulled out of either of the rolled sheets R by the feeding device 200 is conveyed by a sheet conveyance portion (conveyance mechanism) 300 to a printing portion 400 capable of printing the image. The printing portion 400 causes an ink jet print head 18 to eject ink to print the image on the sheet 1. The print head 18 uses an ejection energy generating element such as an electricity/heat conversion element (heater) or a piezoelectric element to cause the ink to be ejected from an ejection port. In the case of using the electricity/heat conversion element, the ink is foamed using heat generated therefrom to allow the ink to be ejected from the ejection port by using foaming energy of the foamed ink. The print head 18 is not limited only to an inkjet method, and a printing method for the printing portion 400 is also not limited. For example, a serial scanning method, a full line method, or the like may also be used. In the case of using the serial scanning method, image printing involving an operation of conveying the sheet 1 and scanning of the print head 18 in a direction crossing a direction of conveyance of the sheet 1 is performed. In the case of using the full line method, image printing is performed using the elongated print head 18 extending in the direction crossing the direction of conveyance of the sheet 1, while the sheet 1 is continuously conveyed.

Each of the rolled sheets R has a form in which the sheet 1 is wound to have a hollowed space portion (hollow hole portion). Into the hollowed space portion of the rolled sheet R, a shaft-shaped spool member 2 is inserted (to extend therethrough), and the spool member 2 is driven by a roll drive motor (not shown) to normally or reversely rotate. As a result, the rolled sheet R is held at a center portion thereof to be normally and reversely rotated in directions indicated by arrows C1 and C2. Each of the feeding devices 200 includes a drive portion 3, an arm member (moving body) 4, an arm rotation shaft 5, a first sheet sensor 6, a swinging member 7, driven rotating bodies (pressure contact bodies) 8 and 9, a separation flapper (upper guiding body) 10, and a flapper rotation shaft 11. In the present embodiment, the feeding devices 200 are provided in upper and lower two stages in the same configuration.

A conveyance guide 12 leads the sheet 1 pulled out of either of the feeding devices 200 to the printing portion 400, while guiding top and back surfaces of the sheet 1. A conveyance roller 14 is normally and reversely rotated by a conveyance roller drive motor in directions indicated by arrows D1 and D2. A nip roller 15 is capable of driven rotation with the rotation of the conveyance roller 14 and can be brought closer to or further away from the conveyance roller 14 by a nip roller separation motor (not shown), while a nipping force thereof can be adjusted by the nip roller separation motor. The conveyance roller 14 is rotated when a second sheet sensor 16 senses a leading end of the sheet 1. A speed at which the sheet 1 is conveyed by the conveyance roller 14 is set higher than a speed at which the sheet 1 is pulled out by the rotation of either of the rolled sheets R. Thus, it is possible to give back tension to the sheet 1 and convey the sheet 1 under tension. As a result, it is possible to prevent loosening of the sheet 1 and prevent formation of a fold line in the sheet 1, while preventing occurrence of a conveyance error.

A platen 17 of the printing portion 400 sucks the back surface of the sheet 1 through a suction port 17*a* using a negative pressure generated by a suction fan 19. Consequently, it is possible to restrict a position of the sheet 1 such that the sheet 1 is along an upper surface of the platen 17 and allow high-accuracy printing of the image by the print head 18. A cutter 20 cuts the sheet 1 having the image printed thereon. The sheet 1 after being subjected to the printing is guided from a paper discharge port (discharge port) 104 provided in a front-side portion (front side surface) 101*a* of a printing apparatus housing 101 to a discharged paper supporting portion (discharge portion) 40 to be discharged. A cover 41 of a rotary door portion 500 prevents the sheet 1 with the printed image discharged from the paper discharge port 104 from returning to the feeding device 200 (containing portion for the rolled sheet R) below the paper discharge port 104.

Figure 3A:
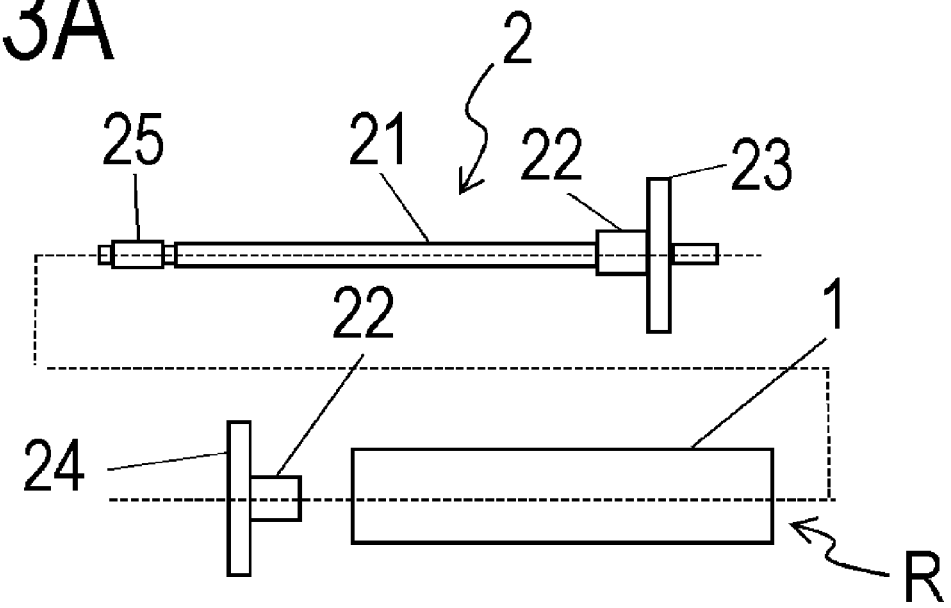
FIGS. 3A to 3C are illustrative views of a spool member in the printing apparatus.
Figure 3B:
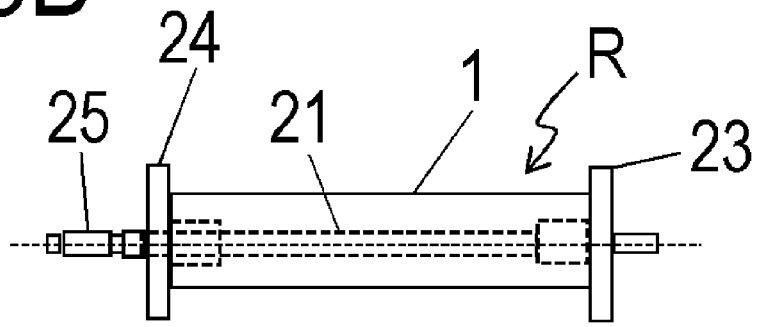
Figure 3C:
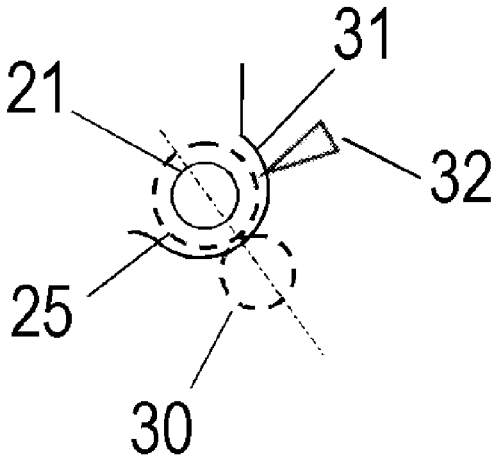

FIGS. 3A, 3B, and 3C are illustrative views of a procedure of setting, using the spool member 2, each of the rolled sheets R in the containing portion of the feeding device 200. The spool member 2 is an auxiliary member to be integrally attached to the rolled sheet R to assist holding of the rolled sheet R in the feeding device 200, which is pivotally supported to be rotatable in the feeding device 200. The spool member 2 includes a spool shaft 21 serving as a shaft portion, frictional members 22, a reference-side spool flange 23 serving as a reference-side flange portion, a non-reference-side spool flange 24 serving as a non-reference-side flange portion, and a spool gear 25. The reference-side spool flange 23 is provided at one end of the spool shaft 21 so as to be in contact therewith in a sheet width direction, while the spool gear 25 for rotating the spool shaft 21 is attached to the other end of the spool shaft 21. The frictional members 22 are provided internally of the reference-side spool flange 23 and the non-reference-side spool flange 24.

When the spool member 2 is to be set into the rolled sheet R, first, the non-reference-side spool flange 24 in which the spool shaft 21 is inserted is detached, and then the spool shaft 21 is inserted into the hollowed space portion of the rolled sheet R. Since an outer diameter of the spool shaft 21 is smaller than an inner diameter of the hollowed space portion of the rolled sheet R and a gap is formed therebetween, the user can insert the spool shaft 21 with small force. When a right end portion of the rolled sheet R in FIG. 3A comes into contact with the reference-side spool flange 23 in the sheet width direction, the frictional member 22 internal of the reference-side spool flange 23 is inserted into the hollowed space portion of the rolled sheet R. Consequently, the reference-side spool flange 23 comes into contact with the rolled sheet R in the sheet width direction to be fixed. Then, the spool shaft 21 is inserted through the non-reference-side spool flange 24 to insert the frictional member 22 internal of the non-reference-side spool flange 24 into the hollowed space portion of the rolled sheet R. As a result, the non-reference-side spool flange 24 comes into contact with the rolled sheet R in the sheet width direction to be fixed.

Thus, as illustrated in FIG. 3B, the rolled sheet R is attached to the spool member 2. Then, as illustrated in FIG. 3C, both end portions of the spool member 2 are press-fitted into spool holders 31 of the feeding device 200 to complete the setting of the rolled sheet R.

In the present embodiment, outer diameters of the spool flanges 23 and 24 are assumed to be, e.g., about 170 mm. Meanwhile, a maximum outer diameter of the rolled sheet R is assumed to be, e.g., about 180 mm, while an inner diameter of the hollowed space portion is assumed to be 2 inches (50.8 mm) or 3 inches (76.2 mm). However, the outer diameters of the spool flanges 23 and 24, the maximum outer diameter of the rolled sheet R, and the inner diameter of the hollowed space portion are not limited to these numerical values.

The spool holders 31 are provided at positions corresponding to both end portions of the spool shaft 21. Each of the spool holders 31 has an inner surface formed into a U-shaped shape, and the end portion of the spool shaft 21 can be press-fitted into the spool holder 31 from an opening side thereof. In a state in which the spool member 2 is press-fitted in the spool holders 31, the spool gear 25 is connected to the roll drive motor via the drive gear 30 on the feeding device 200 side. By the roll drive motor, the rolled sheet R is driven to normally and reversely rotate together with the spool member 2 to allow an operation of feeding the sheet 1 to be performed. Thus, the spool holders 31 function as a feed-out supporting portion that supports the spool member 2 to support the rolled sheet R, while allowing the rolled sheet R to be fed out. A roll sensor 32 senses the presence or absence of the rolled sheet R.

By thus using the spool shaft 21 to hold the rolled sheet R, the rolled sheet R is set in the feeding device 200 via the spool shaft 21 and the spool holders 31 irrespective of a width of the rolled sheet R. Accordingly, the spool shaft 21 is configured to allow the rolled sheet R having a width corresponding to various sizes not more than a length of the spool shaft 21 including large sizes such as, e.g., A0 and A1 and smaller sizes to be set. In addition, since the reference-side spool flange 23 fixed to the spool shaft 21 is attached the end portion of the rolled sheet R, the rolled sheet R is configured such that a position of the reference-side end portion thereof is constantly fixed relative to the feeding device 200.

In the present configuration example, as the auxiliary member that supports the rolled sheet R and sets the rolled sheet R into the feeding device 200, the spool member 2 provided with the spool shaft 21 and the spool flanges 23 and 24 is used. However, as long as a rolled-sheet supporting auxiliary member has a configuration that can rotationally hold the rolled sheet R with respect to the feeding device 200, the rolled-sheet supporting auxiliary member is not limited to a configuration as described above. For example, as a simpler configuration, such a configuration that the spool shaft is not used, and the rolled sheet is rotationally held by a portion of each of flanges attached to both ends of the rolled sheet can be considered. Alternatively, such a configuration that the flanges are not used, and the rolled sheet is fixed by a fixing mechanism provided on the spool shaft can also be considered. However, the auxiliary member described above is limited to a configuration that allows the rolled sheet to be slide-set from a rotary door portion 500 (described later) to the feeding device 200.

The rotary door portion 500 serving as the opening/closing member is provided with roll covers 41 each serving as an exterior surface (outer surface) forming a portion of the front-side apparatus side surface 101*a*, a roll temporary placement table (temporary placement portion) 42 formed of an inner surface, a rotation mechanism 43, and handles 44 (see FIG. 1). The roll covers 41 and the roll temporary placement table 42 are in a back-to-back (front-back) configuration. The rotary door portion 500 is also connected to the feeding device 200 via the rotation mechanism 43 and configured to be rotatable around a rotation shaft in the rotation mechanism 43. This allows switching between a closed state in which the cover 41 covers the feeding device 200 and an open state in which the feeding device 200 is exposed (opened) in a direction toward a front side of the apparatus and the rolled sheet R can be temporarily placed (provisionally mounted) on the roll temporary placement table 42. The position of the rotary door portion 500 being in the open state is an open position, and the position of the rotary door portion 500 being in the closed state is a closed position. In addition, in the rotation mechanism 43, a torque limiter (not shown) is embedded to prevent the rotary door portion 500 from being swiftly opened under a weight thereof when the rotary door portion 500 is opened. The handles 44 are provided on the same side as the roll covers 41 and configured so as not to outwardly protrude from the roll covers 41 in a natural state (see FIG. 1). By manually holding the handles 44 and pushing/pulling the handles 44, the user can open/close the rotary door portion 500.

Figure 4:
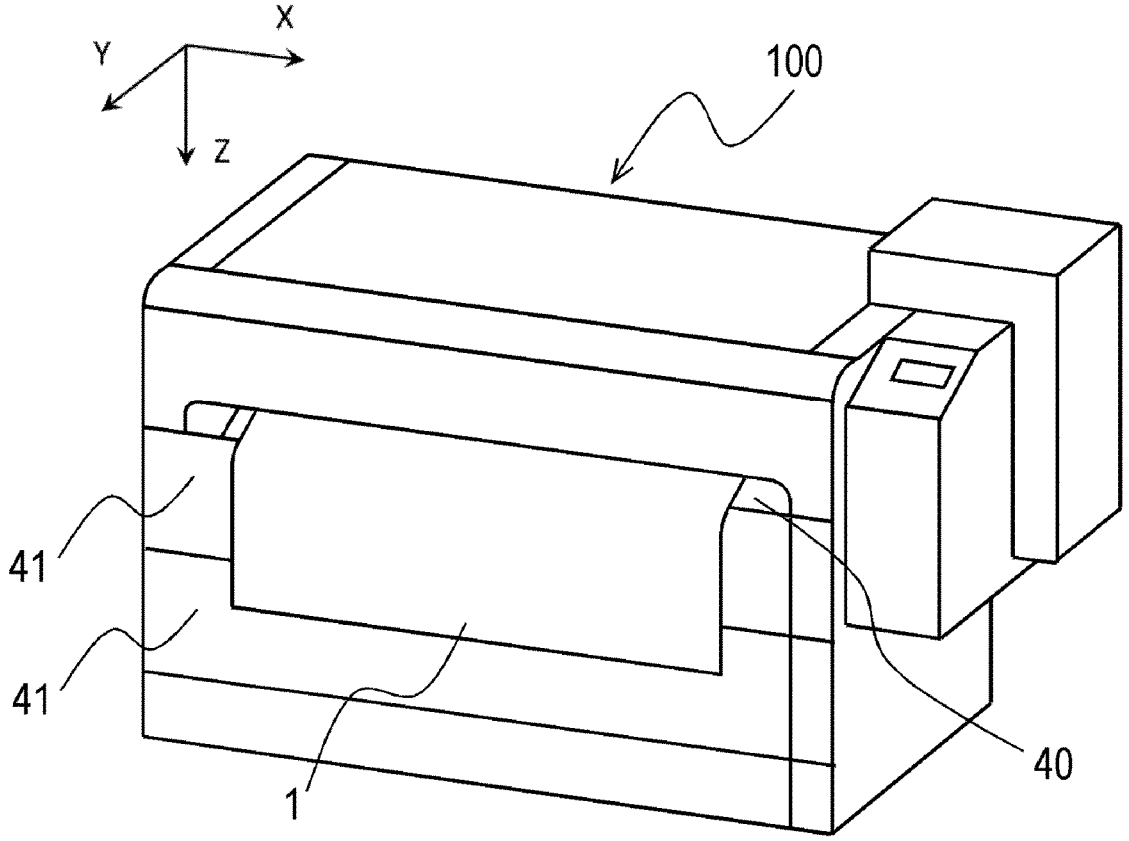
FIG. 4 is an illustrative view of a form of paper discharge in the printing apparatus.

FIG. 4 is an illustrative view of a form of paper discharge in the printing apparatus 100 when the rotary door portion 500 is in the closed state. The sheet 1 after being subjected to the printing is discharged from the discharged paper supporting portion 40 provided in the paper discharge portion 104 provided in the apparatus side surface 101*a* on the front side of the printing apparatus and downwardly guided along the roll covers 41. The discharged paper supporting portion 40 and each of the roll covers 41 are configured to overlap each other in a Y-direction so as to prevent the leading end of the discharged sheet 1 from entering a gap between the discharged paper supporting portion 40 and the roll cover 41. Each of the roll covers 41 is configured to have a surface which is continuous and gapless in a Z-direction when the rotary door portion 500 is in the closed state and prevent the leading end of the discharged sheet 1 from being caught on the cover 41. In the closed state, the rotary door portion 500 is in a posture along the apparatus side surface 101*a*, and the roll temporary placement table 42 formed of the inner surface is horizontally opposed to the rolled sheet R in the containing portion of the feeding device 200.

First Embodiment

Figure 5:
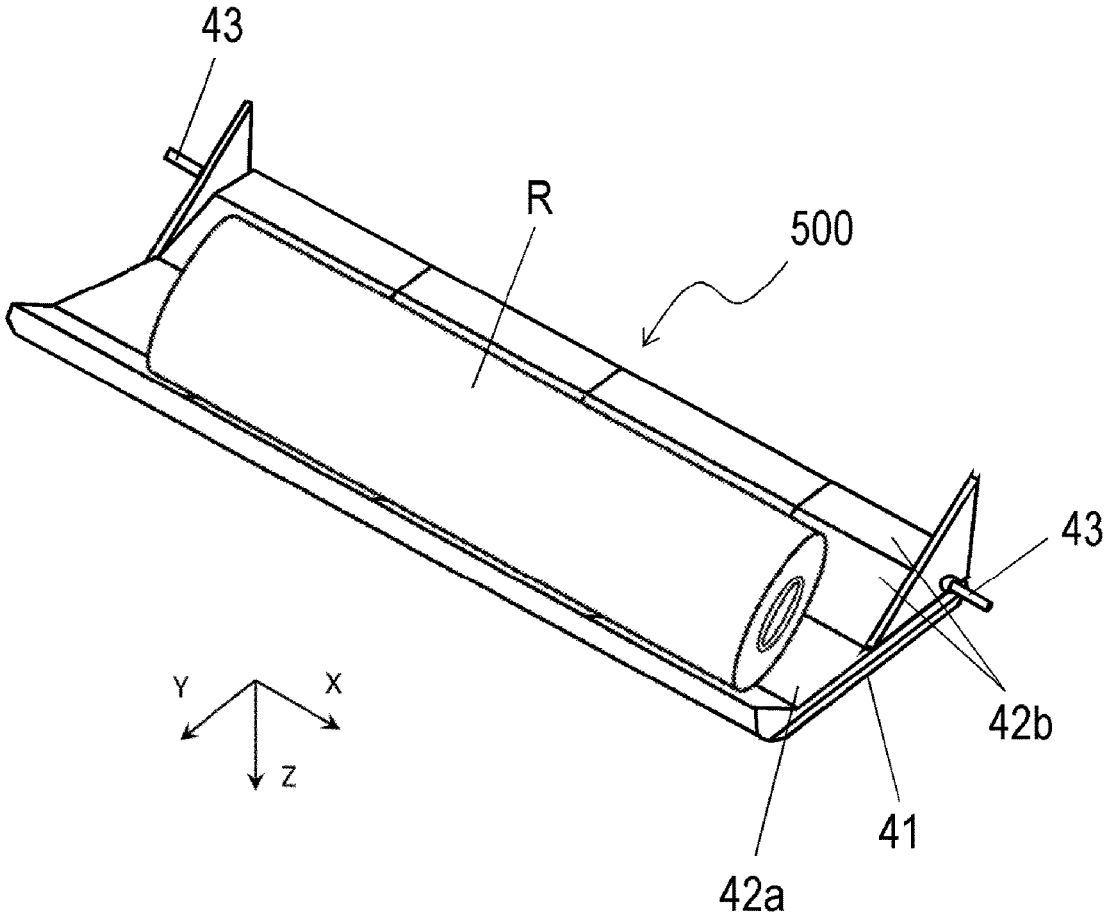
FIG. 5 is an illustrative view of a rotary door portion of the printing apparatus in the first embodiment.
Figure 6:
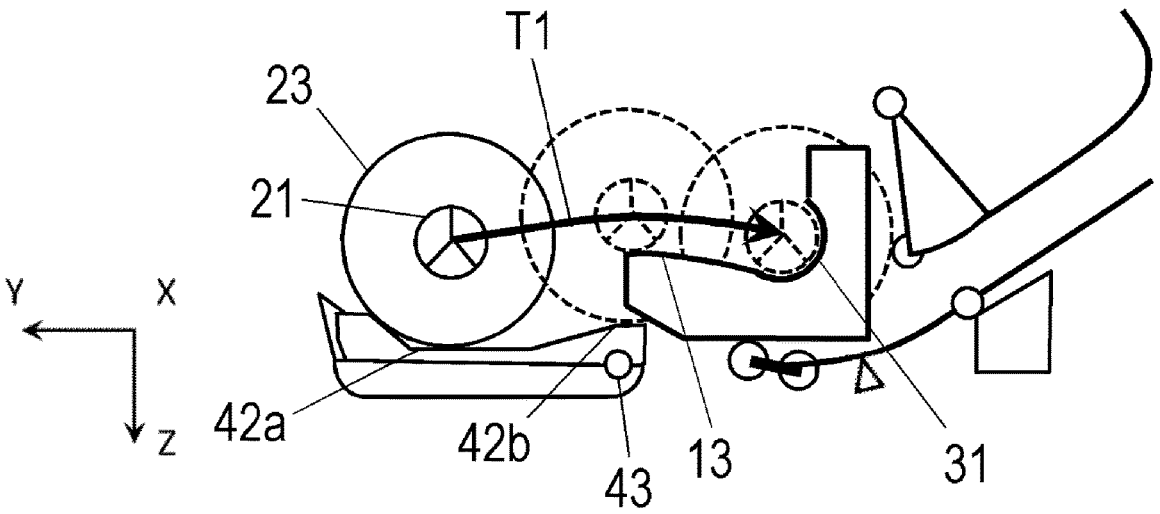
FIG. 6 is an illustrative view of an operation of slide-setting a rolled sheet in the first embodiment.
Figure 7:
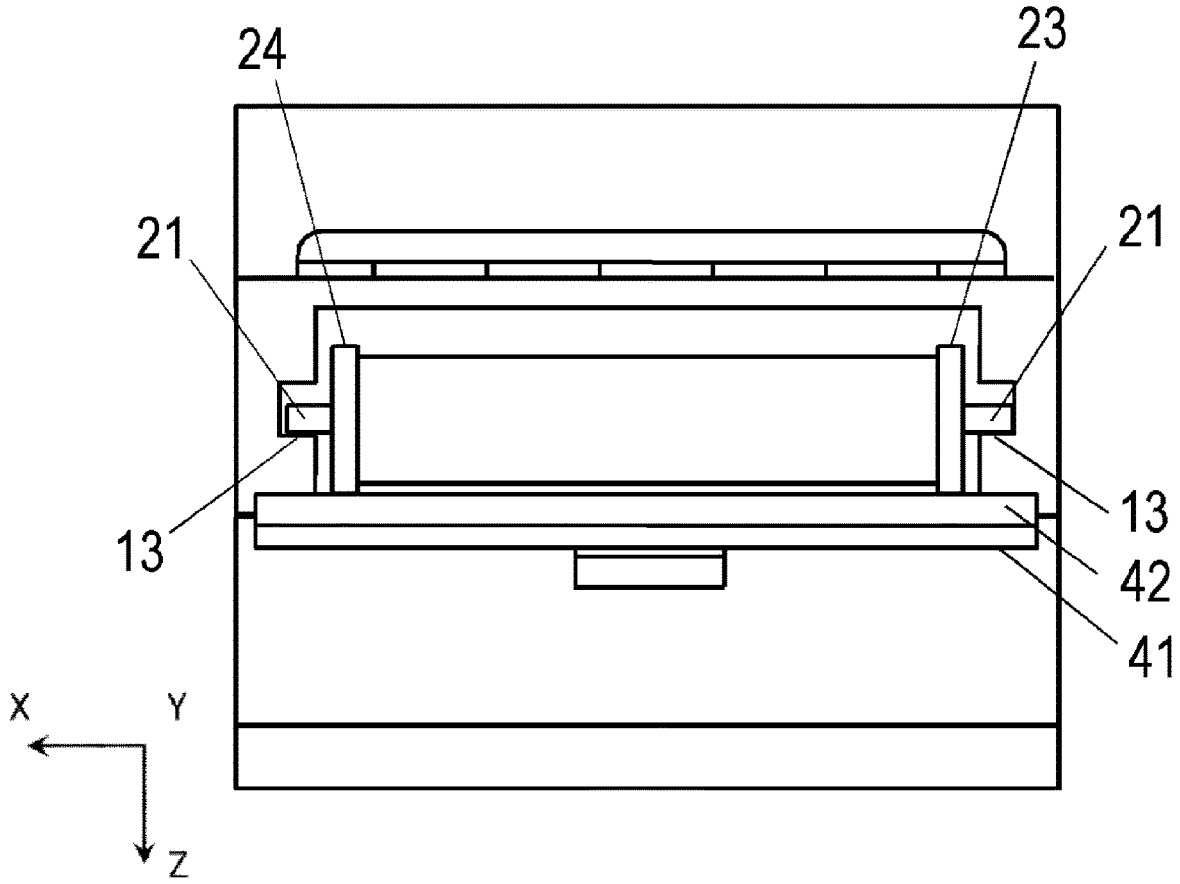
FIG. 7 is a front view of the printing apparatus in the first embodiment.

FIGS. 5 to 7 are illustrative views of a first embodiment illustrating a configuration in which the rolled sheet R is slide-set from a flange guide of the rotary door portion 500 to spool guides of the feeding device 200. FIG. 5 is the illustrative view of a configuration of the rotary door portion 500 when the rolled sheet R is placed thereon. The roll temporary placement table 42 has a surface in the sheet width direction on which the rolled sheet R having any width not more than a width of the rotary door portion and the rolled sheet R to which the spool member 2 is attached can be placed. The surface is provided with a recessed portion 42*a* which is uniform in the sheet width direction, and the rolled sheet placed on the recessed portion 42*a* is stabilized under the weight thereof. The roll temporary placement table 42 has a guiding portion 42*b* directed to the feeding device 200. The guiding portion 42*b* is continued from the recessed portion 42*a* described above to support flange outer shapes of the spool member 2 when the rolled sheet R is set and thereby guide the rolled sheet R to the feeding device 200. In the present embodiment, the recessed portion 42*a* and the guiding portion 42*b* correspond to a first guiding portion and a flange guiding portion of the present invention.

When the rotary door portion 500 is in the open state, the roll temporary placement table 42 is protruding from the front side of the apparatus. In other words, in the open state, the rotary door portion 500 is in a posture horizontally protruding from the apparatus side surface 101*a*, and the roll temporary placement table 42 formed of the inner surface of the rotary door portion 500 is brought into an upwardly open state. Accordingly, into the rolled sheet R placed on the roll temporary placement table 42, the spool member 2 can be inserted sideways. This allows the user to set the spool member 2 into the rolled sheet R without preparing a new setting space such as a desk to set the spool member 2.

FIG. 6 is the illustrative view of an operation of slide-setting the rolled sheet R to which the spool member 2 is attached from the roll temporary placement table 42 to the spool holders 31 of the feeding device 200 when the rotary door portion 500 is in the open state in the first embodiment. An arrow T1 indicates a trajectory of a center of the slide-set rolled sheet R. When the rotary door portion 500 is in the open state, the guiding portion 42*b* overlaps spool guides 13 each serving as a second guiding portion in the Y-direction. Additionally, in the overlapping portions described above, a distance between the guiding portion 42*b* and each of the spool guides 13 in the Z-direction is substantially equal to a distance from each of outer shapes of the spool flanges 23 and 24 of the spool member 2 to an outer shape of the spool shaft 21. In other words, a height of a shaft portion guiding surface of the guiding portion 42*b* is substantially equal to a height from each of lower ends of the spool flanges 23 and 24 to a lower surface of the spool shaft 21 serving as the shaft portion. Moreover, each of the spool flanges 23 and 24 is configured to have the outer shape larger than a diameter of the rolled sheet R.

FIG. 7 is a front view of the entire apparatus when the upper rotary door portion 500 is in the open state in the first embodiment. In FIG. 7, a right side of a front (a negative side along an X-axis) serves as a reference side, and the spool member 2 is set such that the reference-side spool flange 23 is on the right side of the front in the drawing. The spool guides 13 are configured to be disposed at both end portions of the feeding device 200 in the sheet width direction (X-axis direction) and support both ends of the spool shaft 21. When the rolled sheet R is to be slide-set, the flanges 23 and 24 are configured to be inward of both end portions of the spool guides 13.

When the rolled sheet R is to be slide-set, the rolled sheet R to which the spool member 2 is attached is placed on the recessed portion 42*a* of the roll temporary placement table. At this time, lower portions of outer shapes of the spool flanges 23 and 24 are in contact with the recessed portion 42*a*. Next, the rolled sheet R to which the spool member 2 is attached is slid in a direction indicated by the arrow T1. At this time, outer shape portions of the spool flanges 23 and 24 are slid, while being in contact with the guiding portion 42*b* serving as the flange guiding portion (while being supported by the guiding portion 42*b*). When the outer shape portions of the flanges 23 and 24 are slid to the vicinity of the end portion of the guiding portion 42*b*, a lower portion of the spool shaft 21 comes into contact with the spool guides 13 each serving as a shaft portion guiding portion (is brought into a state in which the lower portion of the spool shaft 21 is supported by (placed on) the spool guides 13). When the rolled sheet R is further slid, the spool flanges 23 and 24 move away from the guiding portion 42*b*, but the lower portion of the outer shape of the spool shaft 21 is slid, while being in contact with (supported by) the spool guides 13, to be guided to the spool holders 31.

Thus, the guiding portion 42*b* and the spool guides 13 have respective portions overlapping each other in the Y-direction. By thus configuring the guiding portion 42*b* and the spool guides 13, the rolled sheet R is slide-set, while a portion of the spool member 2 (any part of the spool member 2) is constantly supported by the roll temporary placement table 42 or the spool guides 13. As a result, the user can set the rolled sheet R by merely sliding the rolled sheet R without lifting up the rolled sheet R. Additionally, in the overlapping portions described above, the distance between the guiding portion 42*b* and each of the spool guides 13 in the Z-direction is substantially equal to the distance from each of the outer shapes of the spool flanges 23 and 24 of the spool member 2 to the outer shape of the spool shaft 21. Therefore, it is possible to evenly and smoothly slide the rolled sheet R when the rolled sheet R is transferred from the guiding portion 42*b* to the spool guides 13.

In the present configuration, the spool member 21 is provided with the flanges 23 and 24 serving as a pair of flange portions to allow the rolled sheet R having any diameter smaller than that of each of the flange outer shapes to be slide-set. However, the flanges 23 and 24 are not indispensable for the spool member 21, and the spool member 21 may also have a configuration without a flange having a diameter larger than that of the rolled sheet R. For example, by allowing an outer shape portion of the rolled sheet R to support the rolled sheet R in place of the flanges 23 and 24 described above, it is possible to set the rolled sheet R. In that case, the distance between the guiding portion 42*b* serving as a rolled sheet guiding portion and each of the spool guides 13 in the Z-direction which is substantially equal to the distance from the outer diameter of the rolled sheet R to the outer shape of the spool shaft 21 allows the rolled sheet R to be evenly and smoothly slide-set. For example, when a size of the settable rolled sheet R is determined based on specifications or the like, such a configuration can be used.

According to the present embodiment, by closing the rotary door portion after the rolled sheet is set, while maintaining settability of the rolled sheet in the state in which the rotary door portion is open, it is possible to cover the feeding device 200 (a rolled sheet feeding portion) to prevent entrance of the discharged sheet and also save space.

Note that, in terms of preventing entrance of dust or the like into a feeding device 200 and deposition thereof, the roll covers 41 are preferably in such a shape as to form a wall completely covering the feeding device 200 from outside the apparatus, but the roll covers 41 are not limited to such a configuration. In other words, as long as it is possible to prevent entrance of the sheet discharged outside and above the roll covers 41, the roll covers 41 may also be configured to be locally open without being completely covering the feeding device 200. For example, the roll covers 41 may also have a configuration in which a plurality of ribs are provided in a grid-like pattern or provided to vertically extend in parallel to each other to prevent the entrance of the discharged sheet. Alternatively, the roll covers 41 may also have a configuration having a locally open portion such as an eye hole for checking states of the rolled sheets or the like.

Second Embodiment

Figure 8:
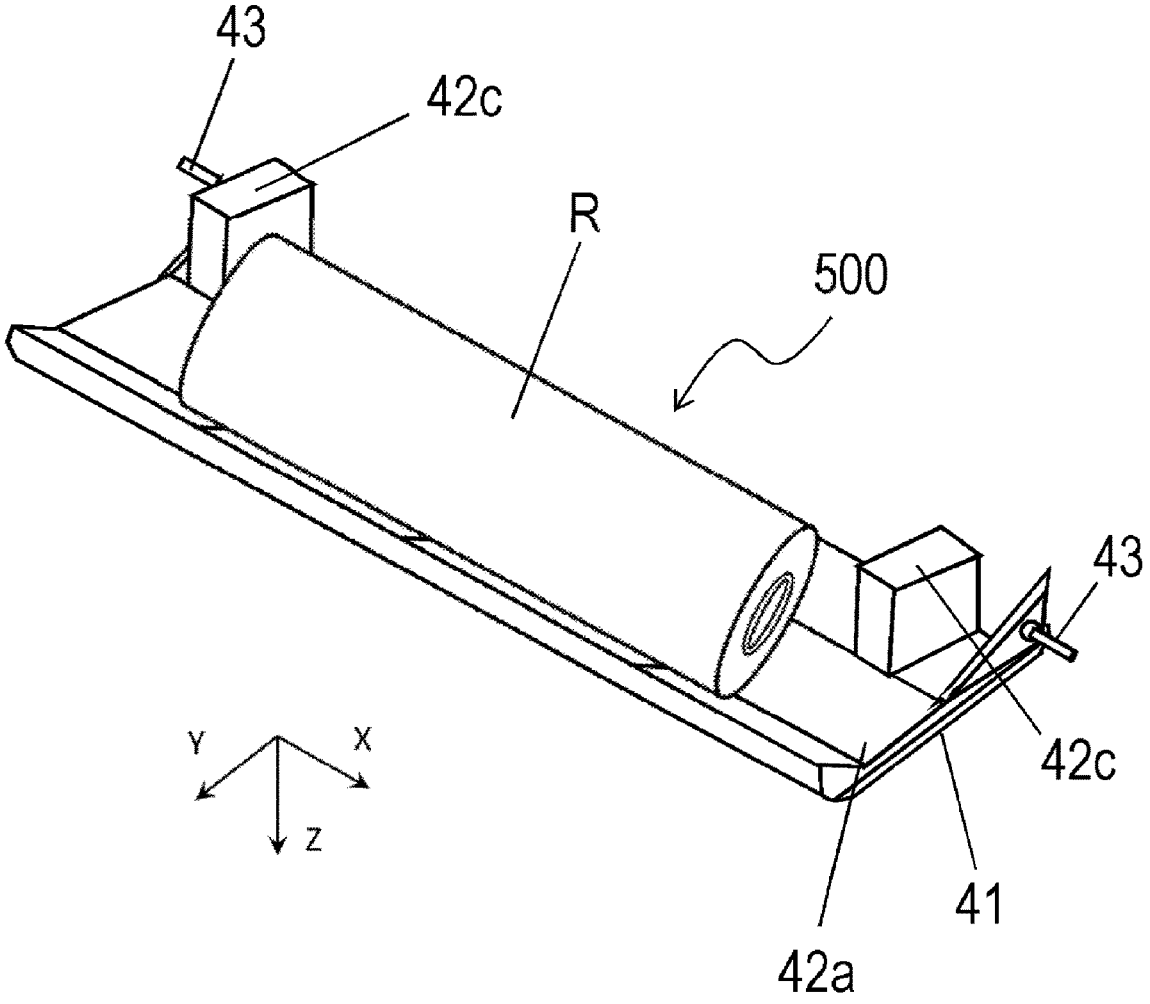
FIG. 8 is an illustrative view of a rotary door portion of a printing apparatus in a second embodiment.
Figure 9:
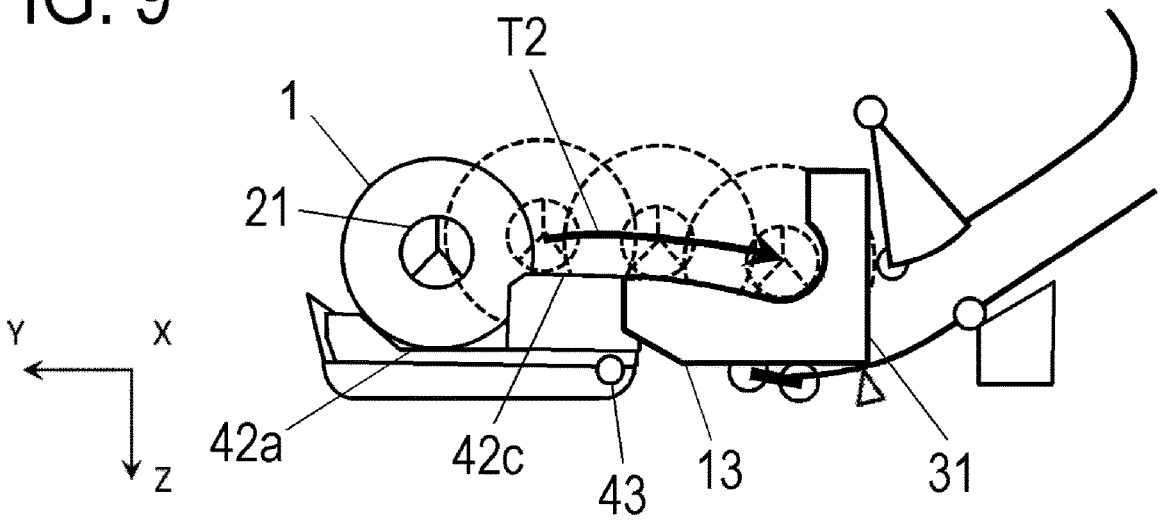
FIG. 9 is an illustrative view of an operation of slide-setting a rolled sheet in the second embodiment.
Figure 10:
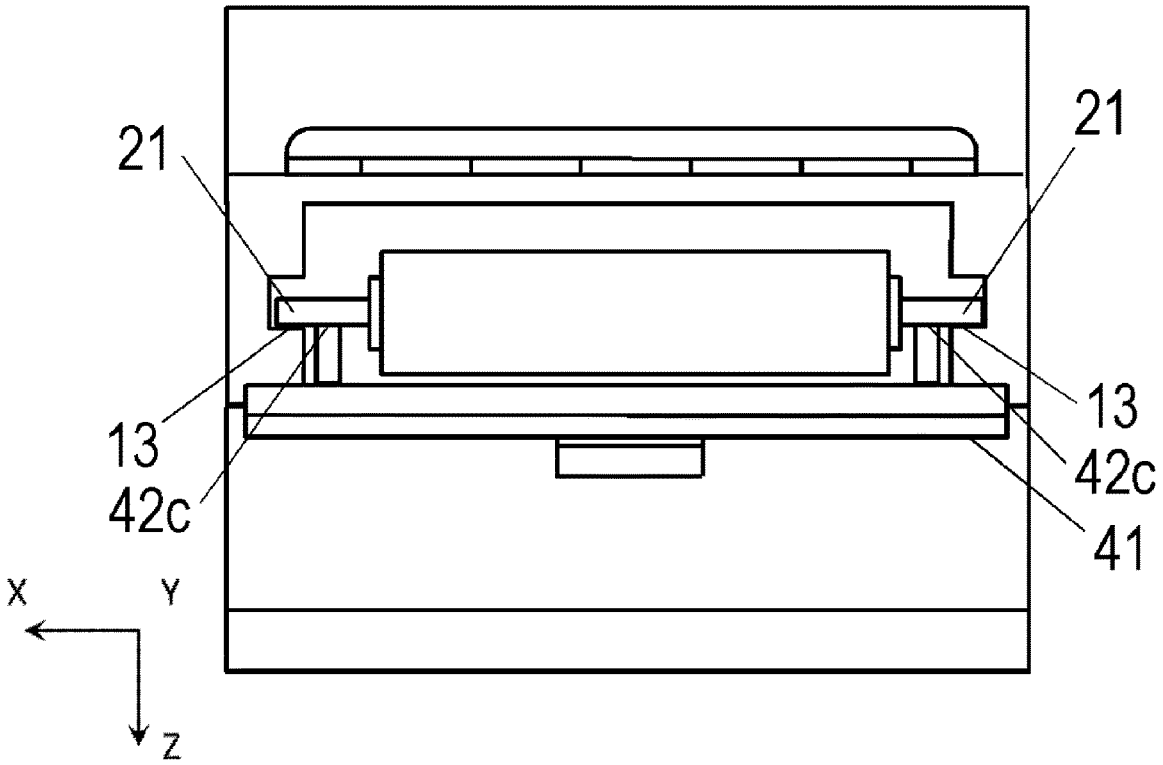
FIG. 10 is a front view of the printing apparatus in the second embodiment.

FIGS. 8 to 10 are illustrative views of a second embodiment and illustrate a configuration in which a rolled sheet is slide-set from spool guides of the rotary guiding portion 500 to spool guides of the feeding device 200. Note that items not particularly described in the second embodiment are the same as in the embodiment described above, and a description thereof is omitted.

FIG. 8 is the illustrative view of a configuration of the rotary door portion 500 when the rolled sheet R is placed thereon. The roll temporary placement table 42 has the surface in the sheet width direction on which the rolled sheet having any width not more than the width of the rotary door portion and the rolled sheet to which the spool member 2 is attached can be placed. The surface is provided with the recessed portion 42*a* which is uniform in the sheet width direction, and the rolled sheet placed on the recessed portion 42*a* is stabilized under the weight thereof. The roll temporary placement table 42 has guiding portions 42*c* each serving as the shaft portion guiding portion that guides the spool shaft 21 of the spool member 2 toward the feeding device 200. The guiding portions 42*c* support the spool shaft 21 of the spool member 2 when the rolled sheet R is set and thereby guide the setting of the rolled sheet R into the feeding device 200.

FIG. 9 is the illustrative view of the operation of slide-setting the rolled sheet R to which the spool member 2 is attached from the roll temporary placement table 42 to the spool holders 31 of the feeding device 200 when the rotary door portion 500 is in the open state in the second embodiment. An arrow T2 indicates a trajectory of the center of the slide-set rolled sheet R. When the rotary door portion 500 is the open state, the guiding portions 42*c* overlap the spool guides 13 in the Y-direction. Additionally, in the overlapping portions described above, the guiding portions 42*c* and the spool guides 13 have respective guiding surfaces at substantially equal heights in the Z-direction. FIG. 10 is a front view of the entire apparatus when the upper rotary door portion 500 is in the open state in the second embodiment. The spool guides 13 are configured to be disposed at both end portions of the feeding device 200 and support both ends of the spool shaft 21. The guiding portions 42*c* of the rotary door portion 500 are configured to be inward of the spool guides 13 in the sheet width direction (X-axis direction). Note that the spool guides 13 may also be disposed/configured to be inward of the guides 42*c* in the sheet width direction.

When the rolled sheet R is to be slide-set, the rolled sheet R to which the spool member 2 is attached is placed on the recessed portion 42*a* of the roll temporary placement table. At this time, the lower portion of the outer shape of the spool flange 23 are in contact with the recessed portion 42*a*. Next, the rolled sheet R is lifted up to place the spool shaft 21 on the guiding portions 42*c*. As a result, the rolled sheet R is supported by the guiding portions 42*c* via the spool shaft 21. Then, the rolled sheet R is slid in a direction indicated by the arrow T2. At this time, the spool shaft 21 is slid, while being in contact with the guiding portions 42*c*. When an outer shape portion of the spool shaft 21 is slid to the vicinity of end portions of the guiding portions 42*c*, the lower portion of the spool shaft 21 comes into contact with the spool guides 13 (is brought into a state in which the lower portion of the spool shaft 21 is supported by (placed on) the spool guides 13). When the rolled sheet R is further slid, the spool shaft 21 moves away from the guiding portions 42*c*, but the lower portion of the outer shape of the spool shaft 21 is slid, while being in contact with the spool guides 13, to be guided to the spool holders 31.

Thus, the guiding portions 42*c* and the spool guides 13 have respective portions overlapping each other in the Y-direction. By thus configuring the guiding portions 42*c* and the spool guides 13, the rolled sheet R is slide-set, while a portion of the spool member 2 (any part of the spool member 2) is constantly supported by the roll temporary placement table 42 or the spool guides 13. As a result, the user can set the rolled sheet R by merely sliding the rolled sheet R. Additionally, in the overlapping portions described above, the guiding portion 42*c* and the spool guides 13 are at the substantially equal heights in the Z-direction. Therefore, it is possible to evenly and smoothly slide the rolled sheet R when the rolled sheet R is transferred from the guiding portions 42*c* to the spool guides 13.

Thus, in the present configuration, the spool shaft 21 is configured to be constantly supported by the guiding portions 42*c* or by the spool guides 13 to allow the rolled sheet R to be slide-set. Accordingly, the flanges 23 and 24 of the spool member 2 are not indispensable components, and it is sufficient that the spool member 2 and the rolled sheet R are fixed by the frictional members 22.

In the configuration described above in the first embodiment, the rolled sheet R is slide-set from the flange guide of the rotary door portion 500 to the spool guides of the feeding device 200 while, in the configuration described in the second embodiment, the rolled sheet R is slide-set from the spool guides of the rotary door portion 500 to the spool guides of the feeding device 200. However, the portion of the rolled-sheet supporting auxiliary member (the spool member 2 in the second embodiment) to be supported when the rolled sheet R is slide-set from the rotary door portion 500 to the feeding device 200 is not limited. In other words, as long as the rolled sheet R is set while a portion of the member assisting the supporting of the rolled sheet R is constantly supported, any portion of the rolled-sheet supporting auxiliary member may be supported. For example, besides the forms in the first and second embodiments, a configuration in which the rolled sheet R is slide-set from the flange guide of the rotary door portion 500 to the flange guides of the feeding device 200 or the like can be considered.

Third Embodiment

The configuration in the prior art literature has a problem in that, when the sheet 1 is discharged from a front side, the sheet 1 enters a paper feeding path to cause a jam. Accordingly, in a third embodiment, a door 41 is provided to form a paper discharge path. A description is given herein of the paper discharge path formed of a lower door 41(*b*) and an upper door 41(*a*). Note that items not particularly described in the third embodiment are the same as in each of the embodiments described above, and a description thereof is omitted.

Figure 11A:
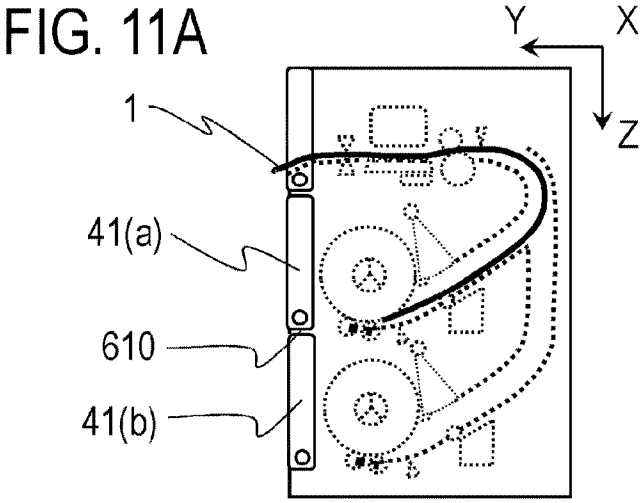
FIGS. 11A to 11E are side views of front side paper discharge in a third embodiment.

Referring to FIGS. 11A, 11B, 11C, 11D, and 11E, a description will be given of paper discharge in the third embodiment. FIG. 11A is a side view of the printing apparatus 100 illustrating a state in which the leading end of the paper sheet 1 is conveyed to the vicinity of an upper portion of the upper door 41(*a*) serving as a first opening/closing member. When there is no gap between a bottom portion of the upper door 41(*a*) and an upper portion of the lower door 41(*b*) when the lower door 41(*b*) serving as a second opening/closing member is to be opened, a problem occurs in that the bottom portion of the upper door 41(*a*) and the upper portion of the lower door 41(*b*) are brought into contact with each other, and the lower door 41(*b*) cannot be opened or is damaged. Accordingly, it is required to provide a gap 610 between the bottom portion of the upper door 41(*a*) and the upper portion of the lower door 41(*b*). However, the leading end of the discharged sheet 1 may enter the gap 610 between the bottom portion of the upper door 41(*a*) and the upper portion of the lower door 41(*b*). This phenomenon will be described with reference to FIG. 11B.

Figure 11B:
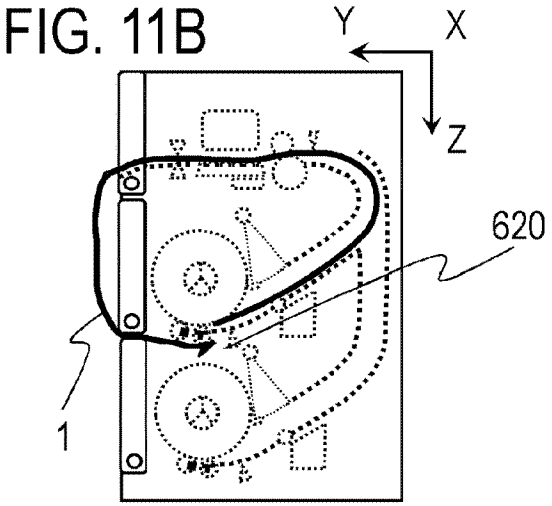

FIG. 11B is a diagram illustrating a state in which the leading end of the sheet 1 has entered the gap 610 and even entered a paper feeding path 620. This phenomenon is likely to be observed with rolled paper which is wound around a paper core and curled and unlikely to be observed with uncurled flat paper, i.e., so-called cut paper. An approach to prevent this phenomenon is erecting a wall in a direction of entrance of the sheet to provide a shape in which the wall overlaps each of the bottom portion of the upper door 41(*a*) and the upper portion of the lower door 41(*b*). At this time, when the wall is provided to extend in overlapping relation from over the lower door 41(*b*) and it is attempted to open the lower door 41(*b*), the lower door 41(*b*) interferes with the upper door 41(*a*) and cannot be opened.

Figure 11C:
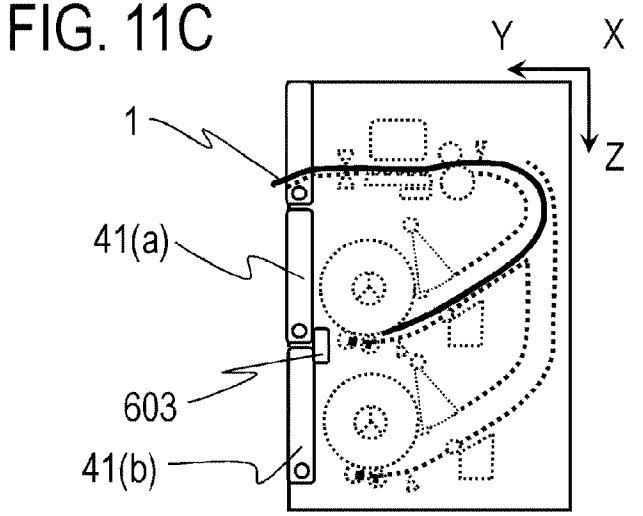

FIG. 11C is a diagram illustrating a configuration in which a wall 603 is provided to cover the gap 610 between the upper door 41(*a*) and the lower door 41(*b*). For the reason described above, as illustrated in FIG. 11C, the wall 603 that prevents the sheet 1 from entering the gap 610 is provided to extend in overlapping relation from over the upper door 41(*a*) to over the lower door 41(*b*) in the Z-direction. In addition, by providing the wall 603 such that the wall 603 is formed on the back side of the upper door 41(*a*) in the Y-direction (in a direction opposite to that indicated by the arrow), it is possible to prevent the entrance of the sheet 1 into the gap 610 without preventing the lower door 41(*b*) from being opened/closed.

Figure 11D:
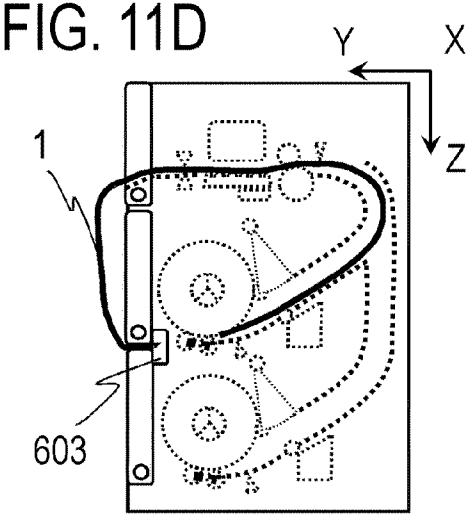

FIG. 11D is a diagram illustrating a state in which the sheet 1 is discharged and the leading end thereof has collided with the wall 603 serving as a restricting portion. As illustrated in FIG. 11D, the leading end of the sheet 1 has collided with the wall 603, and the paper discharge can be continued without the entrance of the sheet 1 into the sheet feeding path 620. In other words, the leading end of the sheet 1 having entered the gap 610 is restricted by the wall 603 from advancing in the gap.

Figure 11E:
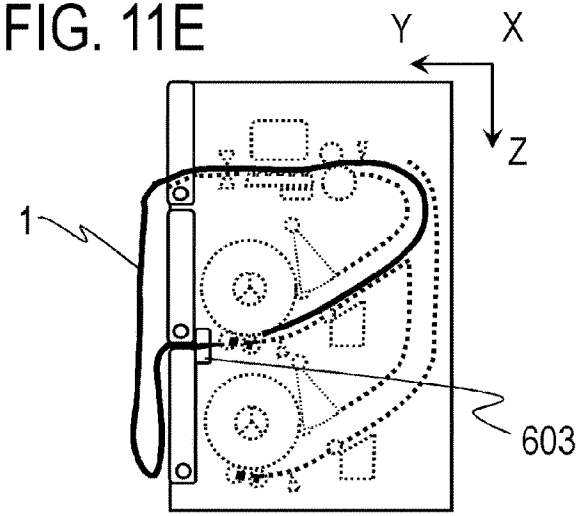

FIG. 11E is a diagram illustrating a case when the paper discharge is continued in a state in which the leading end of the sheet 1 has collided with the wall 603. As illustrated in FIG. 11E, even after the leading end of the sheet 1 collided with the wall 603, a portion of the sheet 1 discharged and conveyed is held in such a manner as to sag, thus allowing the paper discharge. When the paper discharge is further continued, the sheet 1 reaches the ground and, in this case, it may also be possible to place fabric (not shown) or the like on a floor and support the sheet 1. By doing so, it is possible to further continue the sheet discharge without damaging the sheet 1. By thus providing the wall 603, the sheet discharge can be performed without the entrance of the leading end of the sheet 1 into the gap 610 or without further advancement of the leading end of the sheet 1 to the back of the gap even though the leading end of the sheet 1 has entered the gap.

The description has been given heretofore of a height direction (Z-direction) of the wall 603 and a depth direction (Y-direction) thereof. A description will be given hereinafter of a form in which consideration is given even to the settability of the sheet in a width direction (X-direction) of the wall 603.

Figure 12A:
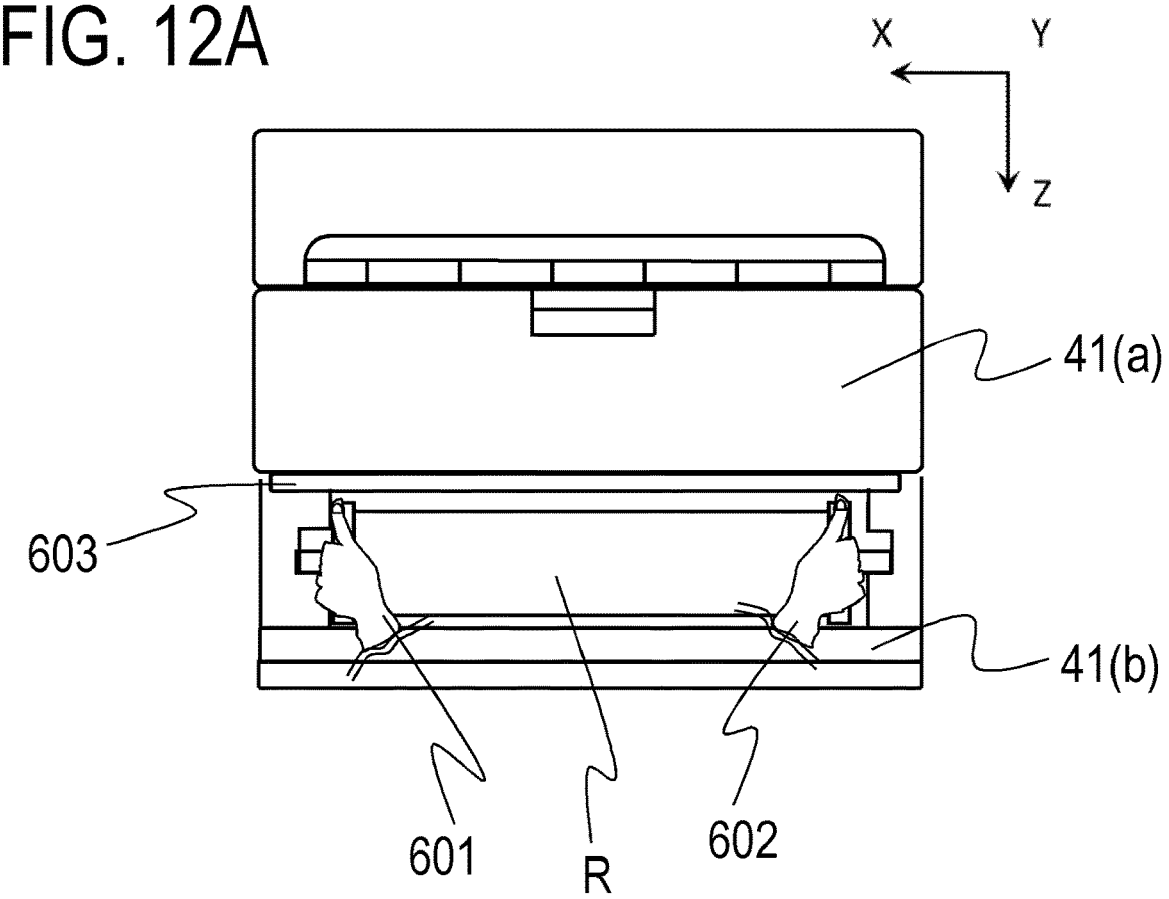
FIGS. 12A and 12B are illustrative views when a rolled sheet is set in the third embodiment.
Figure 12B:
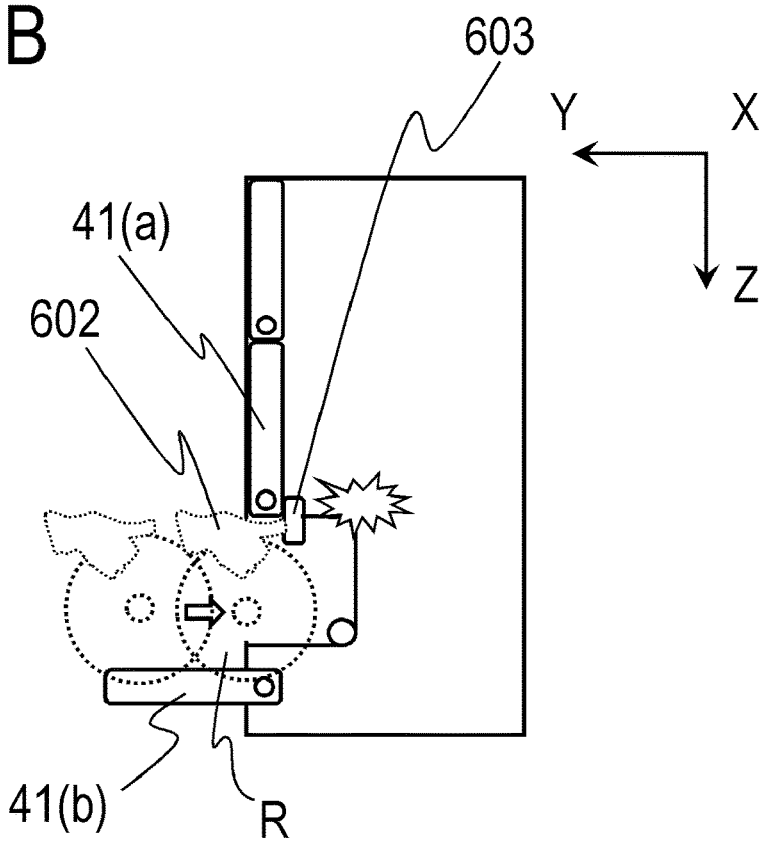

FIG. 12A is a front view when, in a configuration provided with the wall 603, the lower door 41(*b*) is opened and the rolled sheet R is set. FIG. 12B is a right side view when, in the configuration provided with the wall 603, the lower door 41(*b*) is opened and the rolled sheet R is set. As illustrated in FIG. 12A, 601 denotes a left hand of the user who sets the rolled sheet R and denotes a right hand 602 of the person who sets the rolled sheet R. When the flange 23 is held with the right hand 602 and the flange 24 is held with the left hand 601, the rolled sheet R is easily set. In addition, the wall 603 is provided along substantially the entire width of the door 41(*a*) in a widthwise direction (X-direction) of a lower portion of the door 41(*a*). As illustrated in FIG. 12B, the door 41(*b*) is opened, and the rolled sheet R is to be set in a main body. However, when the wall 603 is provided in an entire widthwise region, the right hand 602 and the left hand 601 hit the wall 603, and the rolled sheet R is hard to set. Accordingly, in the third embodiment, the wall 603 is provided only at each of widthwise portions where the wall 603 needs to be provided except for portions corresponding to the widths of the hands of the user holding both ends of the rolled sheet R, thereby preventing the right hand 602 and the left hand 601 from hitting the wall 603 when the rolled sheet R is to be set.

Figure 13A:
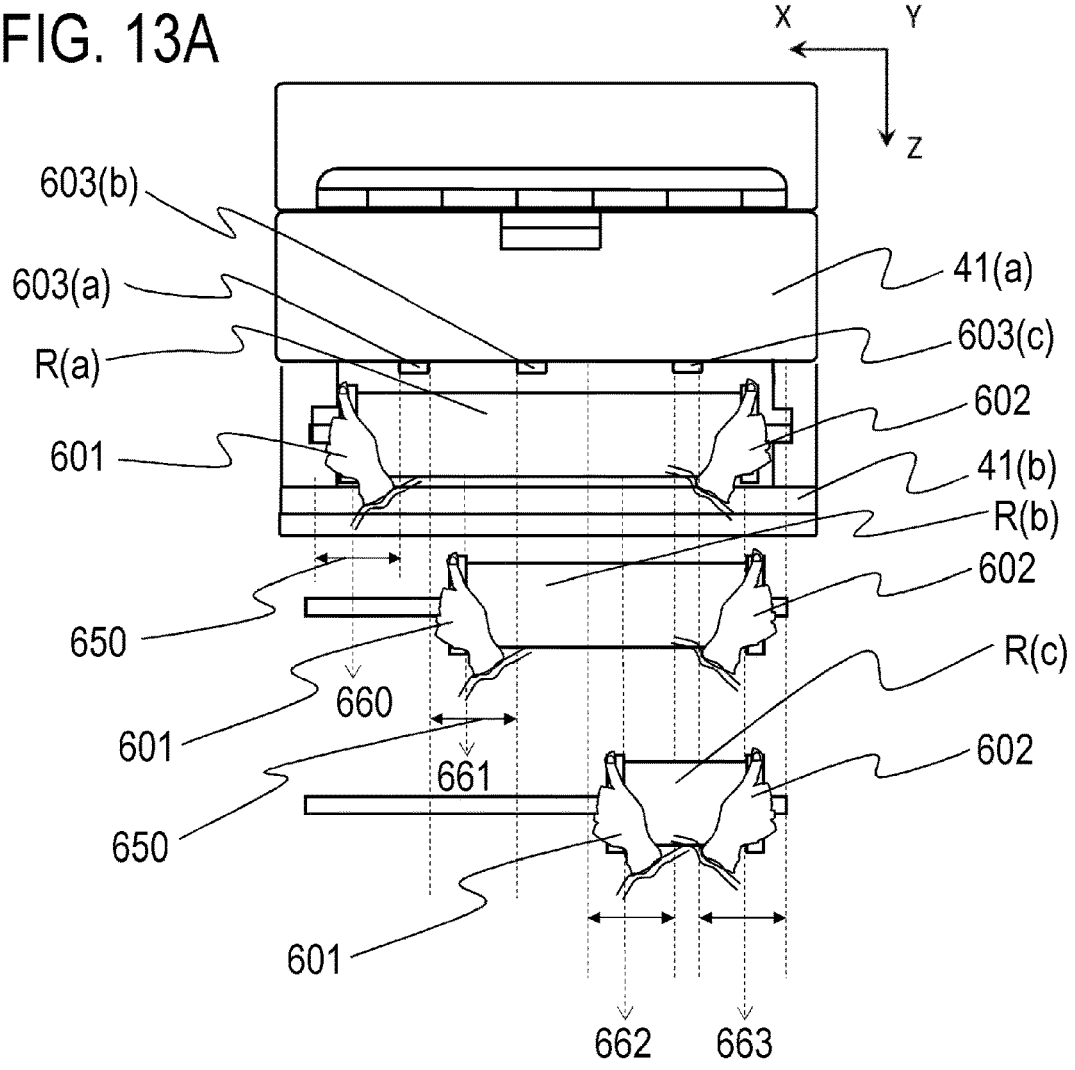
FIGS. 13A and 13B are illustrative view of improved setting of the rolled sheet in the third embodiment.
Figure 13B:
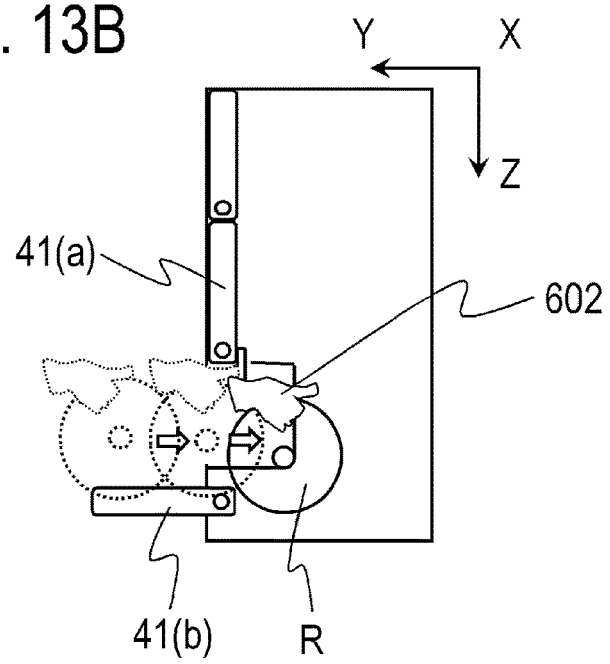

FIG. 13A is a front view when, in a configuration in which the wall 603 is provided at each of positions at which the hands do not hit the wall 603 when the sheet is to be set, the lower door 41(*b*) is opened and the sheet is to be set. FIG. 13B is a right side view when, in the configuration in which the wall 603 is provided at each of the positions at which the hands do not hit the wall 603 when the sheet is to be set, the lower door 41(*b*) is opened and the sheet is to be set.

As illustrated in FIG. 13A, the wall 603 described above is provided as walls 603(*a*), 603(*b*), and 603(*c*) in divided relation in the sheet width direction to serve as a plurality of the restricting portions partially closing the gap 610. As illustrated in FIG. 13B, by holding the flange 23 and the flange 24 with the right hand 602 and the left hand 601, the rolled sheet R is to be set in the feeding device 200. There are a reference-side end portion 663 for paper to be used at that time, a non-reference-side end portion 660 for the rolled sheet R having a maximum widthwise size that can be set in the present apparatus, and a non-reference-side end portion 662 for the rolled sheet R having a minimum widthwise size that can be set in the present apparatus. As illustrated in FIG. 13A, a position of the flange 24 varies depending on the non-reference-side end portion for the size of the rolled sheet R to be used, and a position of the left hand 601 holding the flange 24 in the X-direction also varies depending on the position of the flange 24. Since the hand enters the feeding device 200 while staying at the position in the X-direction, by not providing the wall 603 at the corresponding portion, it is possible to prevent the hand from hitting the wall 603. The following is a configuration obtained by providing the wall 603 at each of positions spaced apart by distances corresponding to widths 650 of the hands when the flange 23 and the flange 24 are held with the hands. A left end of the wall 603 provided rightwardly adjacent to a space corresponding to the width 650 of the hand and extending on both sides of the non-reference-side end portion 660 for the rolled sheet R having the maximum widthwise size that can be set in the present apparatus corresponds to a left end of the wall 603(*a*). At positions on both sides of a space corresponding to the width 650 of the hand and extending on both sides of the non-reference-side end portion 662 for the rolled sheet R having the minimum widthwise size that can be set in the present apparatus, the left and right two walls 603 are provided, and a right end of the left wall 603 and a left end of the right wall 603 correspond to a right end of the wall 603(*b*) and a left end of the wall 603(*c*). When the rolled sheet R having an intermediate size between the maximum size and the minimum size is to be used and it is intended to prevent the hand from hitting the wall 603 when the rolled sheet R is set, a right end of the wall 603(*a*) and a left end of the wall 603(*b*) are determined by providing a space corresponding to the width 650 of the hand and extending on both sides of an intermediate-size non-reference-side end portion 661 between the wall 603(*a*) and the wall 603(*b*). A right end of the wall 603(*c*) is determined so as to be leftwardly adjacent to a space corresponding to the width 650 of the hand and extending on both sides of the reference-side end portion 663 for the rolled sheet R. By thus providing the walls 603 at the positions between which the spaces each corresponding to the width of the hand and extending on both sides of the reference-side and non-reference-side end portions for the sheet sizes to be used when the rolled sheet R is set are provided, the rolled sheet R can be set without entailing the hitting of the walls 603 by the hands when the sheet is set. Accordingly, as illustrated in FIG. 13B, the hands 602 kept away from the wall 603 in the X-direction can set the rolled sheet R in the feeding device 200 without hitting the walls 603.

In the third embodiment, the upper and lower two doors have been described as the door, but the door is not limited thereto. Even when two or more doors are provided, by providing the wall provided in the third embodiment to cover the gap between the door located on an upper side and the door located on a lower side, the same effect can be obtained.

Fourth Embodiment

Figure 14A:
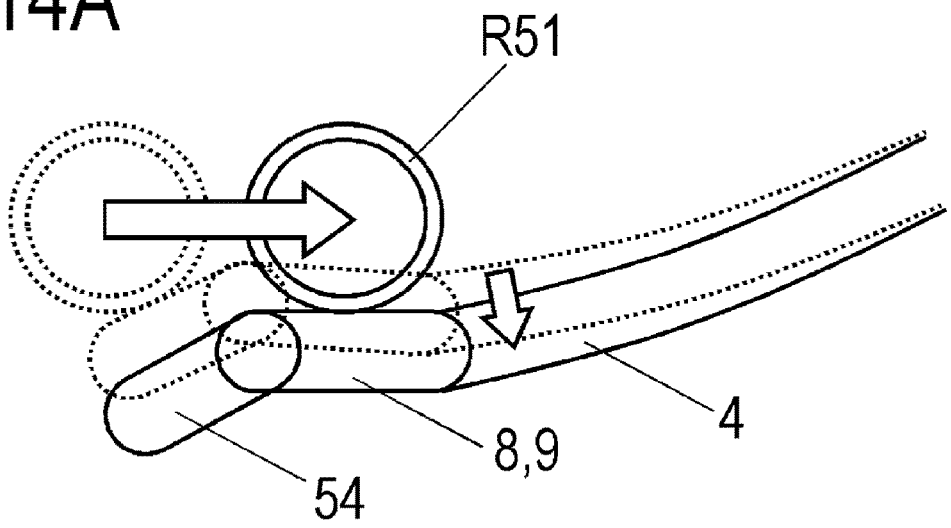
FIGS. 14A and 14B are diagrams each illustrating a positional relationship between each of driven rotating bodies (pressure contact bodies) and the rolled sheet when the rolled sheet is slid-set.
Figure 14B:
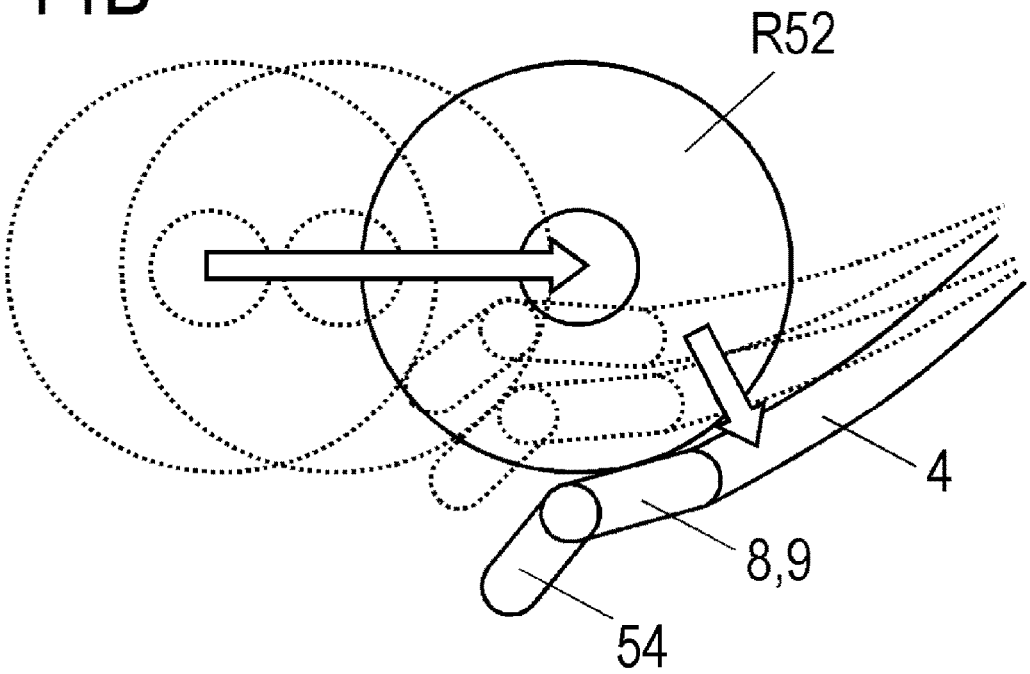

FIGS. 14A and 14B are illustrative views of a fourth embodiment. A detailed description will be given of a positional relationship between the rolled sheet R and each of the driven rotating bodies (pressure contact bodies) 8 and 9 and the arm member (moving body) 4 when the rolled sheet R is to be slide-set to the feeding device 200, as described in the first embodiment. Note that items not particularly described in the fourth embodiment are the same as in each of the embodiments described above, and a description thereof is omitted.

FIG. 14A illustrates the rolled sheet R when a remaining amount thereof is small. FIG. 14B illustrates the rolled sheet R when the remaining amount thereof is large. In the containing portion of the feeding device 200 for the rolled sheet R, the arm member 4 is configured to be rotatable around the arm rotation shaft 5 (see FIG. 2) and provided to be vertically movable (rotatable), together with the driven rotating bodies 8 and 9, depending on the outer diameter of the rolled sheet R. The arm member 4 guides, as a lower guiding body, the lower surface of the sheet 1 fed (pulled) out of the rolled sheet R on a downstream side of positions on the driven rotating bodies 8 and 9 at which the driven rotating bodies 8 and 9 are in pressure contact with an outer peripheral surface of the rolled sheet R in a direction of rotation in which the sheet is fed out of the rolled sheet R. The driven rotating bodies 8 and 9 have rotatable members 54 forming inclined surfaces downwardly inclined to the upstream side, which are provided on upstream-side tip portions thereof in a guiding direction when the rolled sheet R is guided to the containing portion of the feeding device 200.

In FIG. 14A, when the driven rotating bodies (pressure contact bodies) 8 and 9 are at initial positions and a rolled sheet R51 the remaining amount of which is small is to be slide-set, the rolled sheet R51 comes into contact with the rotatable members (movable members) 54 at the tip portions of the driven rotating bodies (pressure contact bodies). Then, the rolled sheet R51 moves to a set position, while pressing down the rotatable members 54 at the tip portions of the driven rotating bodies (pressure contact bodies) and the driven rotating bodies (pressure contact bodies) 8 and 9.

In FIG. 14B, when a rolled sheet R52 the remaining amount of which is large is to be slide-set, the rolled sheet R52 comes into contact with the rotatable members 54 at the tip portions of the driven rotating bodies (pressure contact bodies). After the rotatable members 54 at the tip portions of the driven rotating bodies (pressure contact bodies) rotate alone, the rotatable members 54 are pressed down together with the driven rotating bodies (pressure contact bodies) 8 and 9 to move to positions at which the driven rotating bodies 8 and 9 are in pressure contact with the rolled sheet R. The members 54 are configured to be returned to initial positions (angles) by springs (not shown) or the like after guiding the rolled sheet. Note that the members 54 may also be configured to be fixed to the driven rotating bodies (pressure contact bodies) 8 and 9.

Fifth Embodiment

FIGS. 15A to 15D, FIGS. 16A and 16B, and FIGS. 17A to 17D are illustrative view of a fifth embodiment. As described in the first embodiment, the user can set the spool member 2 into the rolled sheet R on the roll temporary placement table 42 in the printing apparatus, and a detailed description will be given of this portion. Note that items not particularly described in the fifth embodiment are the same as in each of the embodiments described above, and a description thereof is omitted.

Figure 15B:
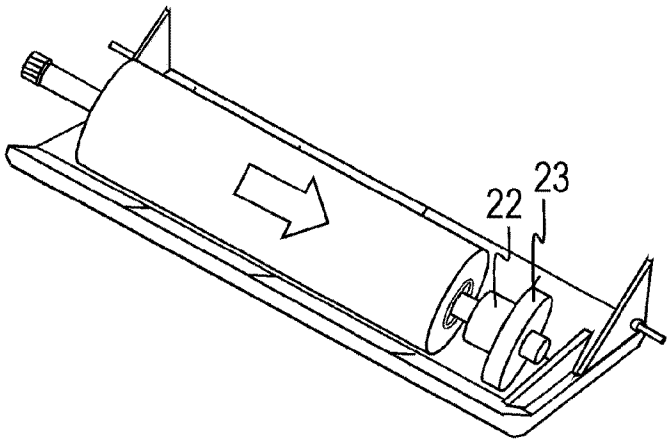
FIGS. 15A to 15D are illustrative views in a fifth embodiment.
Figure 15D:
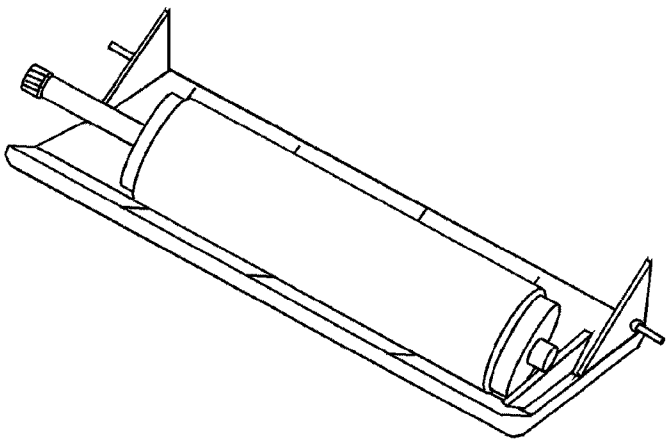
Figure 15A:
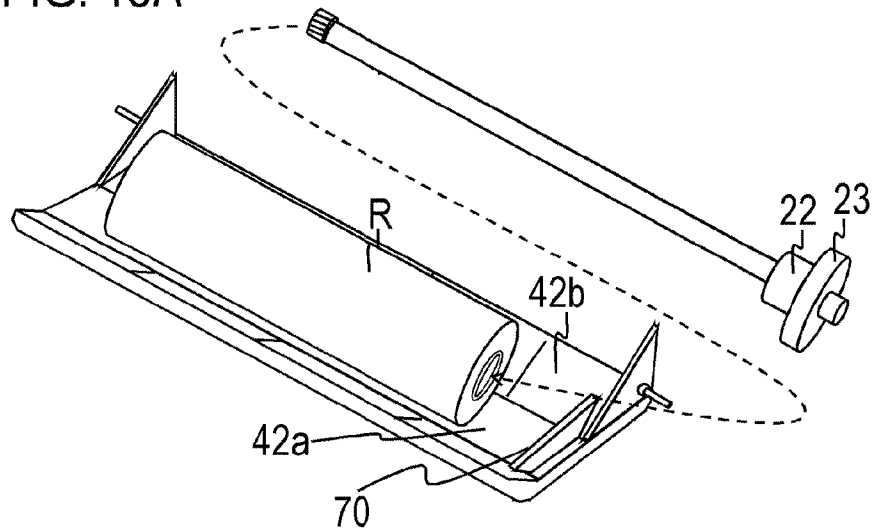
Figure 15C:
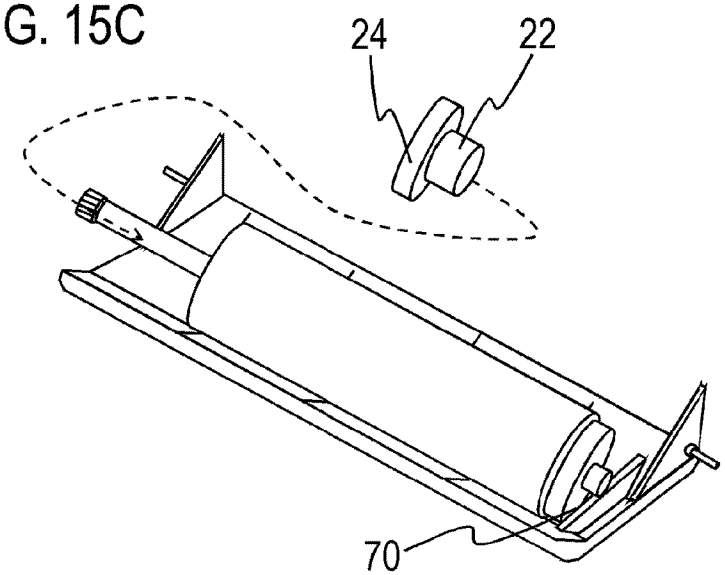

As illustrated in FIG. 15A, the rolled sheet R is placed on the roll temporary placement table 42 when the rotary door portion 500 is in the open state, and the non-reference side of the spool member 2 is inserted into the reference side of the rolled sheet R. Since the roll temporary placement table 42 is in a state protruding from the front side of the apparatus, into the rolled sheet R placed on the roll temporary placement table 42, the spool member 2 can be inserted sideways. Subsequently, as illustrated in FIG. 15B, when the spool member 2 is inserted until the reference-side spool flange 23 passes over an abutment surface 70 located on the roll temporary placement table 42, the rolled sheet R penetrated by the spool member 2 is then moved toward the reference-side spool flange 23 of the spool member 2. When the moving rolled sheet R comes into contact with the reference-side spool flange 23, the reference-side spool flange 23 also moves to the reference side but, when reaching the abutment surface 70, the reference-side spool flange 23 can no longer move. As a result, the rolled sheet R moves to the reference-side spool flange 23 until the reference-side spool flange is attached thereto. When the penetrated rolled sheet R has moved until the reference-side end surface thereof abuts against the reference-side spool flange 23, then, as illustrated in FIG. 15C, the non-reference-side spool flange 24 is attached to the rolled sheet R. In the same manner as described previously, the reference-side spool flange 23 has abutted against the abutment surface 70. Consequently, the rolled sheet R no longer moves and the non-reference-side spool flange 24 can move until abutting against the non-reference-side end surface of the rolled sheet R, as illustrated in FIG. 15D.

Thus, the user can set the spool member 2 into the rolled sheet R on the roll temporary placement table 42 in the printing apparatus, and accordingly a new roll setting space such as a desk is unnecessary. In addition, a step of moving the rolled sheet R from a roll setting space such as a desk to the printer is also unnecessary. When the spool member 2 is inserted into the rolled sheet R on a desk or the like, it is necessary for the user to perform an operation, while pressing the rolled sheet R with his or her hand to prevent the rolled sheet R from moving. However, as described previously, by using the abutment surface 70 provided on the temporary placement table 42, such an operation is unnecessary. This reduces an operation load.

Figure 16B:
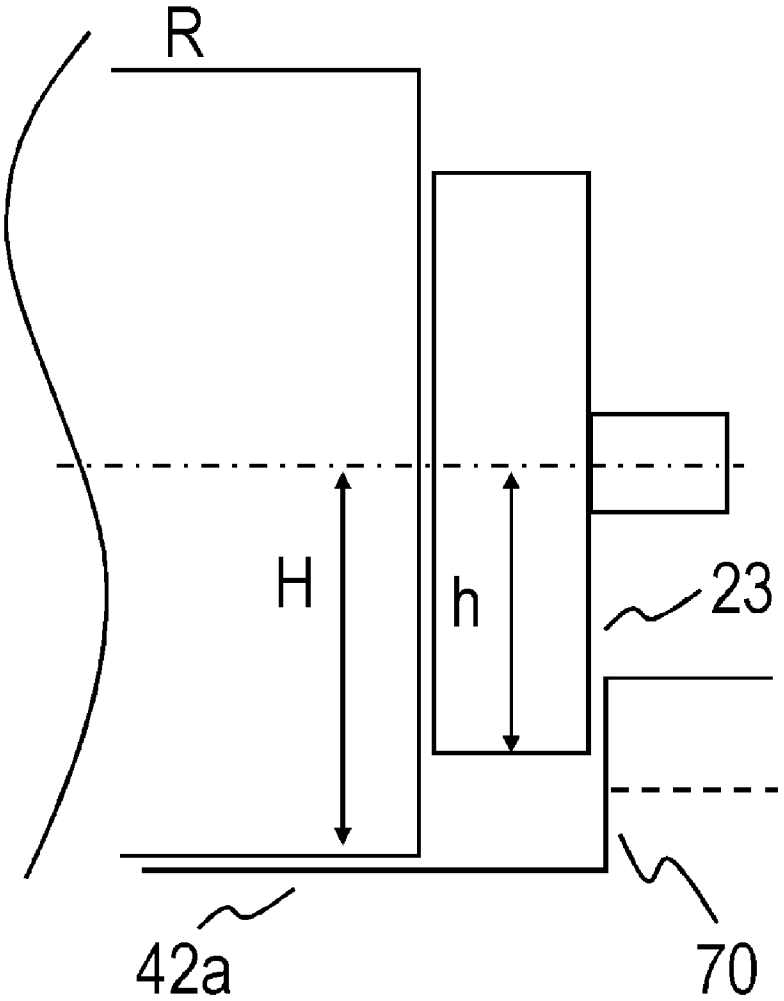
FIGS. 16A and 16B are illustrative views in the fifth embodiment.
Figure 16A:
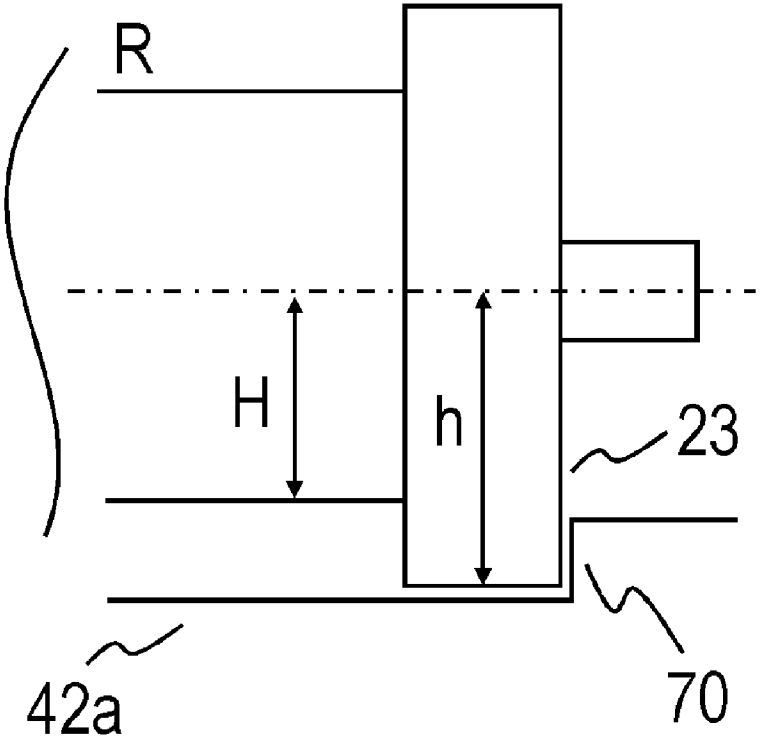

With regard to the height of the abutment surface 70, when a radius H of the rolled sheet is smaller than a radius h of the reference-side spool flange 23 as illustrated in FIG. 16A, the reference-side spool flange 23 inevitably abuts against the abutment surface 70. For instance, in a specific example, the abutment surface may be configured appropriately to have a height of 5 mm. Meanwhile, as illustrated in FIG. 16B when the radius H of the rolled sheet is larger than the radius h of the reference-side spool flange 23, it is necessary to provide the abutment surface with a height of not less than H-h to allow the reference-side spool flange 23 to abut against the abutment surface 70. For instance, in a specific example, when H=87.5 mm and h=83 mm are satisfied, the height of the abutment surface needs to be not less than 4.5 mm, and accordingly the abutment surface may be configured appropriately to have a height of 9.5 mm or the like in consideration of mechanical size variation.

Figure 17A:
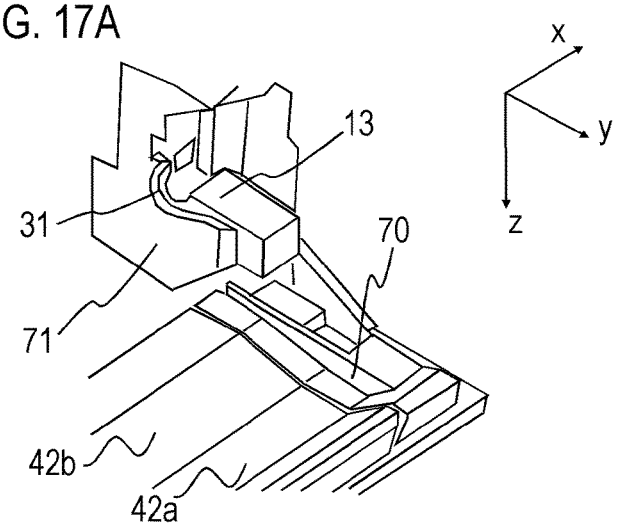
FIGS. 17A to 17D are illustrative views in the fifth embodiment.
Figure 17B:
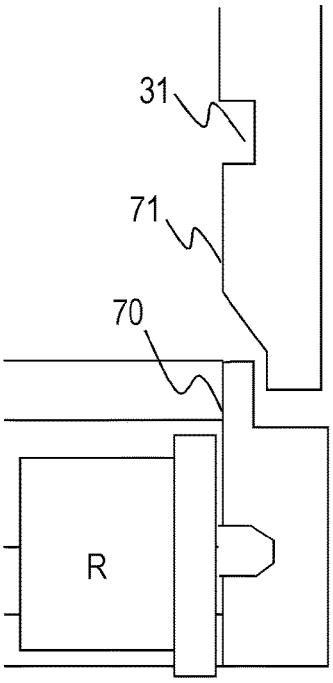
Figure 17C:
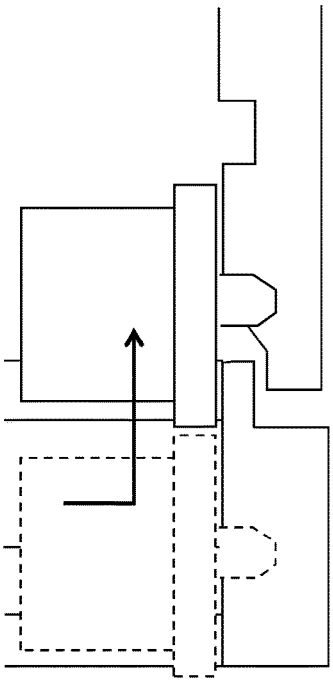
Figure 17D:
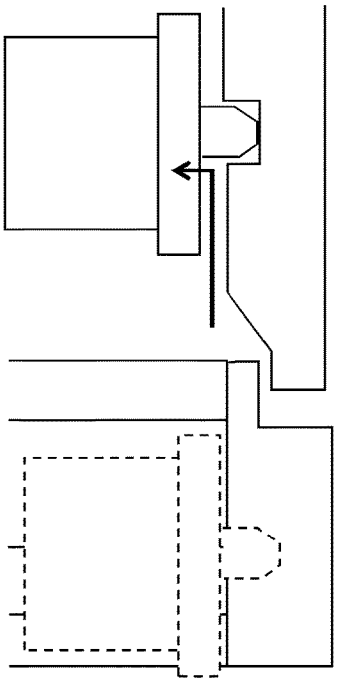

After the spool member 2 is set into the rolled sheet R, the rolled sheet R is led to the printing apparatus, while the spool flanges or the bottom of the rolled sheet R is slid along the guiding surface 42, as described previously. As illustrated in FIG. 17A, the abutment surface 70 extends in a negative Y-axis direction. In addition, each of spool guides 13 serving as spool supporting portions of a printing apparatus main body includes a guiding surface 71 serving as a flange guiding surface capable of coming into contact with the spool holders 31 that support the spool during printing and the reference-side spool flange 23. FIGS. 17B to 17D are diagrams obtained when FIG. 15A is viewed in an arrow Z direction. The abutment surface 70 forms a surface substantially flush with the guiding surface 71. As illustrated in FIG. 17B, the user performs an operation of sliding the rolled sheet R placed on the roll temporary placement table 42 to the main body, while bringing the rolled sheet R closer to the reference side as illustrated in FIG. 17C. At this time, the abutment surface 70 and the guiding surface 71 serve as a guide for the reference-side spool flange 23 to be able to lead the rolled sheet R to the printing apparatus main body. Then, as illustrated in FIG. 17D, the spool shaft end is engaged with the spool guide 13 to complete roll setting. The engagement of the spool shaft end with the spool guide 13 keeps the reference-side spool flange 23 from contact with the guiding surface 71. After the roll is set in the main body, the rotary door portion 500 is brought into the closed state to complete the sheet setting. By thus providing the guiding surface 71 substantially flush with the abutment surface 70, it is possible to easily lead the rolled sheet R to a main body set position.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-168383, filed on Oct. 5, 2020, which is hereby incorporated by reference herein in its entirety.

What is claimed is:

1. A recording apparatus comprising:

a containing portion that contains a rolled sheet obtained by winding a sheet;

a recording portion that records an image on the sheet fed from the rolled sheet contained in the containing portion;

a cover member movable between an open position at which the rolled sheet can be placed on the cover member before being placed in the containing portion and a closed position at which the containing portion is covered;

a first guiding portion provided in the cover member to guide the rolled sheet to the containing portion in a case where the cover member is at the open position; and a discharge portion provided above the cover member to discharge the sheet on which the image is recorded by the recording portion, wherein in a case where the cover member is at the closed position, an upper side of the cover member forms a portion of a discharge port of the discharge portion.

2. The recording apparatus according to claim 1, wherein the discharge portion, is provided above the containing portion, and wherein, at the closed position, the cover member restricts entrance of the sheet discharged from the discharge portion.

3. The recording apparatus according to claim 1, further comprising a second guiding portion that guides the rolled sheet guided by the first guiding portion to allow the rolled sheet to be contained in the containing portion.

4. The recording apparatus according to claim 3, wherein the first guiding portion and the second guiding portion are configured such that the guiding of the rolled sheet by the second guiding portion is continued from the guiding of the rolled sheet by the first guiding portion.

5. The recording apparatus according to claim 3, further comprising an auxiliary member to be integrally attached to the rolled sheet to assist holding of the rolled sheet in the containing portion, the auxiliary member having a shaft portion to be pivotally supported in the containing portion, wherein the second guiding portion guides the shaft portion to thereby guide the rolled sheet to the containing portion.

6. The recording apparatus according to claim 5, wherein the auxiliary member has flange portions to be attached to the shaft portion so as to widthwise come into contact with widthwise both ends of the rolled sheet, and wherein the first guiding portion has a flange guiding portion that guides the flange portions.

7. The recording apparatus according to claim 6, wherein a guiding surface of the flange guiding portion that guides the flange portions and a guiding surface of the second guiding portion that guides the shaft portion overlap each other in a direction in which the rolled sheet is guided.

8. The recording apparatus according to claim 5, wherein the first guiding portion has a shaft portion guiding portion that guides the shaft portion.

9. The recording apparatus according to claim 8, wherein a guiding surface of the shaft portion guiding portion that guides the shaft portion and a guiding surface of the second guiding portion that guides the shaft portion overlap each other in a direction in which the rolled sheet is guided.

10. The recording apparatus according to claim 5, wherein the first guiding portion has a rolled sheet guiding portion that guides an outer peripheral surface of the rolled sheet.

11. The recording apparatus according to claim 10, wherein a guiding surface of the rolled sheet guiding portion that guides the shaft portion and a guiding surface of the second guiding portion that guides the shaft portion overlap each other in a direction in which the rolled sheet is guided.

12. The recording apparatus according to claim 5, wherein the cover member has a temporary placement portion on which, at the open position, the rolled sheet can temporarily be placed before being guided by the first guiding portion.

13. The recording apparatus according to claim 12, wherein the auxiliary member includes the shaft portion to be inserted into a hollowed space portion of the rolled sheet and a pair of flange portions to be attached to the shaft portion so as to widthwise come into contact with widthwise both ends of the rolled sheet, and wherein the temporary placement portion has an abutment surface against which one of the pair of flange portions is allowed to widthwise abut in a case where the auxiliary member is attached to the rolled sheet.

14. The recording apparatus according to claim 13, wherein the second guiding portion has a flange guiding surface that widthwise comes into contact with one of the pair of flange portions to guide the flange portion, and wherein the abutment surface and the flange guiding surface are at substantially same widthwise positions to form a guiding surface which is indiscrete in a direction in which the rolled sheet is guided.

15. The recording apparatus according to claim 1, wherein the cover member has an inner surface provided with the first guiding portion and an outer surface that guides, at the closed position, the sheet discharged from the discharge port.

16. The recording apparatus according to claim 15, wherein the open position is a position at which the cover member is in a posture horizontally protruding from an apparatus side surface provided with the discharge port of the discharge portion and the inner surface is upwardly open, and wherein the closed position is a position at which the cover member is in a posture to be along the apparatus side surface and the inner surface is horizontally opposed to the rolled sheet in the containing portion.

17. The recording apparatus according to claim 1, further comprising:

a first containing portion provided below a discharge portion that discharges the sheet on which the image is recorded by the recording portion and a second containing portion provided below the first containing portion, the first containing portion and the second containing portion serving as the containing portion;

a first cover member provided correspondingly to the first containing portion and a second cover member provided below the first cover member correspondingly to the second containing portion, the first cover member and the second cover member serving as the cover member; and a restricting portion that restricts the sheet discharged from the discharge portion from advancing in a gap between the first cover member and the second cover member.

18. The recording apparatus according to claim 17, wherein the restricting portion forms a wall partially closing the gap in a widthwise direction of the rolled sheet.

19. The recording apparatus according to claim 18, wherein the wall is provided in plurality and formed at positions at distances corresponding to respective widths of hands of the user holding widthwise both ends of the roller sheet from both ends of the rolled sheet.

20. The recording apparatus according to claim 1, further comprising:

a pressure contact body that comes, from below, into pressure contact with an outer peripheral surface of the rolled sheet contained in the containing portion; and a lower guiding body provided vertically movable together with the pressure contact body depending on an outer diameter of the rolled sheet to guide a lower surface of the sheet pulled out of the rolled sheet on a downstream side of a position on the pressure contact body at which the pressure contact body is in the pressure contact with the outer peripheral surface in a direction of rotation of the rolled sheet, wherein the pressure contact body has, at a tip portion thereof on an upstream side in a guiding direction in a case where the rolled sheet is guided to the containing portion, an inclined surface downwardly inclined to the upstream side.

21. The recording apparatus according to claim 20, wherein the inclined surface guides, in a case where the rolled sheet is guided to the containing portion, the rolled sheet to the position at which the pressure contact body is in the pressure contact with the rolled sheet.

* * * * *